US005605778A

United States Patent [19]

Onuma et al.

[11] Patent Number: 5,605,778

[45] Date of Patent: Feb. 25, 1997

[54] TONER WITH WAX COMPONENT FOR DEVELOPING ELECTROSTATIC IMAGE

[75] Inventors: Tsutomu Onuma, Yokohama; Satoshi Matsunaga, Tokyo; Manabu Ohno, Funabashi; Minoru Shimojo, Kawasaki, all of Japan

[73] Assignee: Canon Kabushiki Kaisha, Tokyo, Japan

[21] Appl. No.: 627,112

[22] Filed: Apr. 3, 1996

[30] Foreign Application Priority Data

Apr. 7, 1995 [JP] Japan ..... 7-107051

[51] Int. Cl.[6] ..... G03G 9/097

[52] U.S. Cl. ..... 430/110; 430/111

[58] Field of Search ..... 430/110, 111

[56] References Cited

U.S. PATENT DOCUMENTS

| | | | |
|---|---|---|---|
| 4,917,982 | 4/1990 | Tomono et al. | 430/99 |
| 5,225,303 | 7/1993 | Tomita et al. | 430/106.6 |
| 5,364,722 | 11/1994 | Tanikawa et al. | 430/110 |
| 5,384,224 | 1/1995 | Tanikawa et al. | 430/106 |

FOREIGN PATENT DOCUMENTS

| | | | |
|---|---|---|---|
| 0408471 | 1/1991 | European Pat. Off. | G03G 9/08 |
| 0531990 | 3/1993 | European Pat. Off. | G03G 9/087 |
| 0572896 | 12/1993 | European Pat. Off. | G03G 9/083 |
| 0587540 | 3/1994 | European Pat. Off. | G03G 9/087 |
| 52-3305 | 1/1977 | Japan . | |
| 58-215659 | 12/1983 | Japan . | |
| 62-100775 | 5/1987 | Japan | G03G 9/08 |
| 4-124676 | 4/1992 | Japan | G03G 9/08 |
| 4-299357 | 10/1992 | Japan | G03G 9/08 |
| 4-362953 | 12/1992 | Japan | G03G 9/08 |
| 5-197192 | 8/1993 | Japan | G03G 9/08 |

*Primary Examiner*—Roland Martin

*Attorney, Agent, or Firm*—Fitzpatrick, Cella, Harper & Scinto

[57] ABSTRACT

A toner for developing electrostatic images is prepared from a binder resin, a colorant or magnetic material, and a wax component. The toner is provided with improved low-temperature fixability anti-electrostatic offset characteristic, anti-blocking characteristic and anti-offset characteristic by controlling the thermal characteristic of the wax component so as to provide a DSC (differential scanning colorimeter) curve on temperature increase, showing a minimum onset temperature of heat absorption of at least 50° C. and at least two heat absorption peaks including a largest and a second largest peaks, different from each other in peak temperature by at least 15° C., wherein low-temperature heat absorption peak $P_1$ of the two peaks shows a half-value width of at most 20° C. and a higher-temperature heat absorption peak $P_2$ shows a half-value width of at most 20° C., and wherein the peak $P_1$ shows a higher half-width temperature and the peak $P_2$ shows a lower half-width temperature different form the higher half-width temperature of the peak $P_1$ by at least 5° C.

21 Claims, 7 Drawing Sheets

TONER WITH WAX COMPONENT FOR DEVELOPING ELECTROSTATIC IMAGE

FIELD OF THE INVENTION AND RELATED ART

The present invention relates to a toner for developing electrostatic images used in image forming methods, such as electrophotography and electrostatic recording.

In order to prevent a toner from sticking onto a fixing roller surface, it has been conventionally practiced to compose the fixing roller surface of a material showing excellent releasability against the toner, (e.g., silicone rubber or fluorine-containing resin) and further coating the surface with a film of a liquid showing a good releasability, such as silicone oil, so as to prevent the offset and deterioration of the fixing roller surface. This method is very effective for preventing offset but requires a device for supplying such an offset preventing liquid, thus resulting in complication of a fixing apparatus.

Further, this is contrary to the demand for a smaller and lighter apparatus and can sometimes soil the inside of the apparatus due to vaporization of the silicone oil, etc., by the application of heat. Therefore, based on a concept of supplying an offset-preventing liquid from inside toner particles under heating instead of using a device of supplying silicone oil, there has been proposed to incorporate a release agent, such as low-molecular weight polyethylene or low-molecular weight polypropylene. Addition of such a release agent in an amount exhibiting a sufficient effect is liable to lead to other practical problems, such as filming onto a photosensitive member, soiling of the surface of a carrier or a toner-carrying member, such as a sleeve. Accordingly, there has been adopted a combination of adding a release agent in an amount small into toner particles and supplying a small amount of a release oil or using a cleaning device including a web used little by little to be wormed up for removing offset toner.

The addition of waxes as a release agent in toner particles has been known, as disclosed in, e.g., Japanese Patent Publication (JP-B) 52-3304, JP-A 52-3305, and JP-A 57-52574.

These waxes have been used to provide a toner improved in anti-offset characteristic at low or high temperature. However, the addition of these waxes have led to adverse effects, such as deterioration of anti-blocking property, deterioration of developing performance of the toner in some cases.

In order to further improve the effect of the wax addition, a toner containing at least two types of waxes has been disclosed in, e.g., JP-B 52-3305, and Japanese Laid-Open Patent Applications (JP-A) 58-215659, 62-100775, H4-124676, H4-299357, H4-362953, and H5-197192.

However, some toner is excellent in high-temperature anti-offset characteristic and developing performance but is somewhat inferior in low-temperature fixability. Some toner is excellent in low-temperature anti-offset characteristic and low-temperature fixability but is somewhat inferior in anti-blocking characteristic or results in a lower developing performance at the time of successive image formation. Some toner is insufficient in satisfaction of anti-offset characteristic at both low and high temperatures. Some toner causes occurrence of toner blotches on a developing sleeve due to an ununiform toner coat layer resulting from, e.g., isolation of a wax component, thus resulting in image defects.

The waxes contained in the above-mentioned toners provide a DSC curve on temperature increase, as measured by a differential scanning calorimeter, showing a heat absorption peak or showing a main heat absorption peak in low or high temperature region, so that the waxes contain a large amount of a component which deteriorates a resultant toner and exhibits less effect.

SUMMARY OF THE INVENTION

An object of the present invention is to provide a toner for developing an electrostatic image having solved the above problems.

A more specific object of the invention is to provide a toner for developing an electrostatic image excellent in low-temperature fixability and anti-offset characteristic and providing a wide fixable temperature range.

Another object of the invention is to provide a toner for developing an electrostatic image excellent in anti-blocking characteristic and free from lowering in developing performance during a continuous image formation operation.

Another object of the present invention is to provide a toner for developing an electrostatic image containing little amount of a wax component isolated from toner particles and not causing a blotch on a developing sleeve due to an ununiform thickness of a toner coat layer on the sleeve.

Another object of the invention is to provide a toner for developing an electrostatic image excellent in anti-electrostatic offset characteristic.

A further object of the invention is to provide a toner for developing an electrostatic image free from melt-sticking or filming of a toner component onto a photosensitive member.

According to the present invention, there is provided a toner for developing an electrostatic image, comprising: a binder resin, a colorant or a magnetic material, and a wax component; wherein the wax component provides a DSC curve on temperature increase, as measured by a differential scanning calorimeter, showing a minimum onset temperature of heat absorption of at least 50° C. and at least two heat absorption peaks including a largest peak and a second largest peak of which a lower temperature peak $P_1$ and a higher temperature peak $P_2$ have a peak temperature difference therebetween of at least 15° C., the lower temperature peak $P_1$ shows a half-value width of at most 20° C. between a lower half-width temperature $L_1P$ and a higher half-width temperature $H_1P$, and the higher temperature peak $P_2$ shows a half-value width of at most 20° C between a lower half-width temperature $L_2P$ and a higher half-width temperature $H_2P$, satisfying:

$$L_2P-H_1P \geqq 5° \text{ C.}$$

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
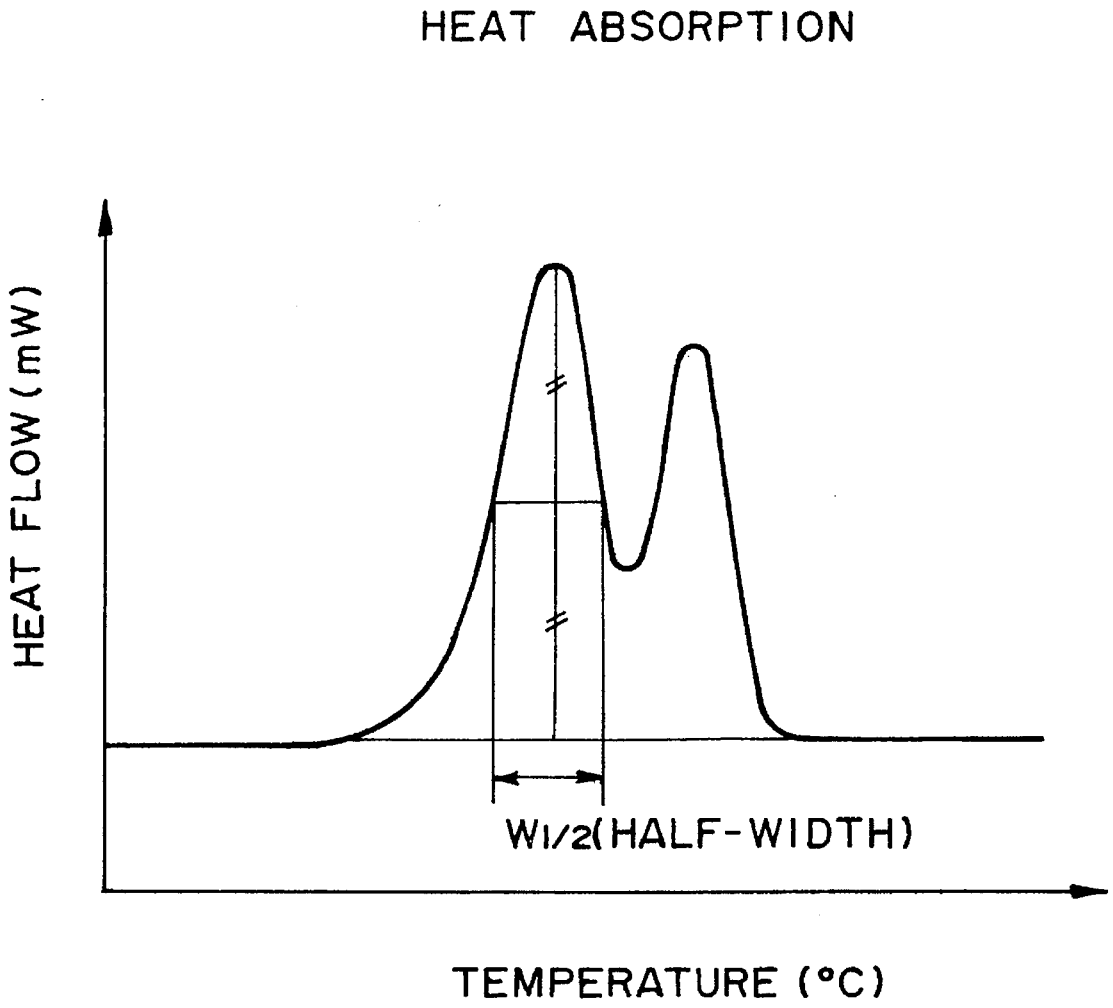
FIGS. 1–3 each show an embodiment of a heat absorption peak portion of a DSC curve on temperature decrease for illustration of a half-value width.

By analyzing data on temperature increase obtained by subjecting a wax component to differential scanning calorimetry by using a DSC (differential scanning calorimeter), it is possible to observe a state change of a wax component under heat application and heat absorption peaks accompanying phase transition and melting or fusion of the wax component.

The wax component used in the present invention is characterized by having a difference in temperature between a higher half-width (termination) temperature ($H_1P$) of a lower-temperature (heat absorption) peak $P_1$ and a lower half-width (initiation) temperature ($L_2P$) of a higher-temperature (heat absorption) peak $P_1$ (i.e., $L_2P$-$H_1P$) of at least 5° C., whereby the resultant toner is provided with a release effect in a wide temperature region to enlarge or broaden a fixation temperature region and non-offset temperature region of the toner. If the above temperature difference is below 5° C., most of the wax component is melted or fused in an intermediate temperature region between peak temperatures of the lower and higher heat absorption peaks $P_1$ and $P_2$. As a result, a component contributing to a low-temperature fixability or an anti-offset characteristic of the toner is relatively decreased, thus failing to remarkably widen a fixation temperature region.

The wax component is also characterized by having a half-value width with respect to the lower-temperature heat absorption peak $P_1$ of at most 20° C., whereby a wax component being quickly melted in a certain and relatively lower temperature region can be effectively incorporated into toner particles to impart a plasticizing effect to a binder resin. As a result, the toner is improved in the anti-offset characteristic and fixability at low temperatures. If the half-value width of the heat absorption peak $P_1$ is above 20° C., a large amount of the wax component is required to be incorporated into toner particles in order to provide the resultant toner with a prescribed (desired) low-temperature fixability and anti-offset characteristic. Consequently, the toner shows a high cohesion to lower a developing performance.

The wax component is further characterized by having a half-value width with respect to the higher-temperature heat absorption peak $P_2$ of at most 20° C., whereby a wax component being quickly melted in a certain and relatively higher temperature heat absorption peak $P_2$ can be effectively incorporated into toner particles to impart a high-temperature releasability to the toner, thus attaining a good anti-offset characteristic at high temperatures. If the half-width of the heat absorption peak $P_2$ is above 20° C., an isolated (or free) wax component within the toner is increased. As a result, a uniformity of a toner coat layer on a developing sleeve is liable to be impaired, thus being liable to cause blotches.

The wax component shows a minimum onset temperature of at least 50° C., whereby it is possible to suppress an excessive plasticizing effect to a low-molecular weight component of a binder resin, thus ensuring an anti-blocking characteristic. If the minimum onset temperature is below 50° C., the anti-blocking characteristic is lowered.

In the present invention, the wax component may preferably have a half-value width of the heat absorption peak $P_1$ of at most 10° C. and a half-value width of the heat absorption peak $P_2$ of at most 15° C., whereby it is possible to improve a dispersibility of the wax component in toner particles and a uniform chargeability of the toner and it is also possible to provide an improved anti-electrostatic offset characteristic.

Incidentally, an electrostatic offset phenomenon is generally caused due to the following factor.

A coating layer of a fixing roller provided to a fixing device may comprise a fluorine-containing resin, such as PFA (tetrafluoroethylene-perfluoroalkyl vinyl ether copolymer), PTFE (polytetrafluoroethylene) or FEP (fluoroethylene-propylene copolymer). The fluorine-containing resin has good electrical insulating properties, thus being liable to be negatively charged. For this reason, in the case of a positively chargeable toner, the toner is liable to electrostatically attach to the fixing roller surface during a fixation operation, thus being liable to cause an electrostatic offset phenomenon. Particularly, if isolated wax particles are present within toner particles, a part of the toner particles is liable to be positively charged abnormally, thus accelerating electrostatic attachment of the toner particles to the fixing roller surface (electrostatic offset phenomenon).

In the present invention, the wax component may preferably show a temperature difference between $H_1P$ and $L_2P$ described above of at least 15° C., whereby a high-melting point wax is not readily plasticized by a low-melting point wax in case where the high and low-melting point waxes are used as the wax component. As a result, it is possible to prevent the wax component from softening or melting within toner particles, thus further effectively suppressing melt-sticking (or filming) of the toner onto a photosensitive member surface.

The wax component may preferably have a lower temperature (heat absorption) peak $P_1$ in a temperature range of 55°–90° C., more preferably 60°–85° C., and a higher temperature (heat absorption) peak $P_2$ in a temperature range of above 90° C. to 150° C., more preferably 95°–130° C. If the lower and higher temperature peaks $P_1$ and $P_2$ are present in the above temperature ranges, the anti-blocking characteristic of the toner is further improved and the melt-sticking of the toner is effectively suppressed while improving the low-temperature fixability and the high-temperature anti-offset characteristic, Examples of the wax component to be incorporated in the toner of the present invention may include: aliphatic hydrocarbon waxes, such as low-molecular weight polyethylene, low-molecular weight polypropylene, microcrystalline wax, and paraffin wax, oxidation products of aliphatic hydrocarbon waxes, such as oxidized polyethylene wax, and block copolymers of these; waxes containing aliphatic esters as principal constituents, such as carnauba wax, sasol wax, montanic acid ester wax, and partially or totally deacidified aliphatic esters, such as deacidified carnauba wax. Further examples of the wax component may include: saturated linear aliphatic acids, such as palmitic acid, stearic acid, montanic acid and long-chain alkylcarboxylic acid; unsaturated aliphatic acids, such as brassidic acid, eleostearic acid and parinaric acid; saturated alcohols, such as stearyl alcohol, aralkyl alcohol, behenyl alcohol, carnaubyl alcohol, ceryl alcohol, melissyl alcohol, and long-chain alkyl alcohol; polyhydric alcohols, such as sorbitol; aliphatic acid amides, such as linoleylamide, oleylamide, and laurylamide; saturated aliphatic acid bisamides, methylene-bisstearylamide, ethylene-biscaprylamide, ethylene-bislaurylamide, and hexamethylene-bisstearylamide; unsaturated aliphatic acid amides, such as ethylene-bisolerylamide, hexamethylene-bisoleylamide, N,N'-dioleyladipoylamide, and N,N'-dioleylsebacoylamide, aromatic bisamides, such as m-xylene-bisstearoylamide, and N,N'-distearylisophthalylamide; aliphatic acid metal salts (generally called metallic soap), such as calcium stearate, calcium laurate, zinc stearate, and magnesium stearate; grafted waxes obtained by grafting aliphatic hydrocarbon waxes with vinyl monomers, such as styrene and acrylic acid; partially esterified products between aliphatic acids and polyhydric alcohols, such as behenic acid monoglyceride; and methyl ester compounds having hydroxyl group as obtained by hydrogenating vegetable fat and oil.

Specific examples of the wax component preferably used in the present invention may include e.g., a low-molecular weight alkylene polymer obtained through polymerization of an alkylene by radical polymerization under a high pressure or in the presence of a Ziegler catalyst or another catalyst under a low pressure; an alkylene polymer obtained by thermal decomposition of an alkylene polymer of a high molecular weight; a purified product of a low-molecular weight alkylene polymer obtained as a by-product through polymerization of an alkylene; and a polymethylene wax obtained by subjecting a mixture gas containing carbon monoxide and hydrogen to the Arge process to form a hydrocarbon polymer mixture and distilling the hydrocarbon mixture to recover a residue, optionally followed by hydrogen addition. These wax components may further contain an antioxidant. Other examples of the wax component may preferably include linear alcohols, linear fatty acids, linear acid amides, linear esters, montan-based derivatives, and purified products of these waxes wherefrom an impurity such as liquid fatty acid is removed.

Of the above wax components, it is further preferred to use a polymer of an olefin, such as ethylene obtained by using a Ziegler catalyst or another catalyst or its by-product; a hydrocarbon wax, such as a Fischer-Tropsh wax, obtained from a hydrocarbon having up to several thousand carbon atoms, particularly up to about 1000 carbon atoms; a long-chain alkyl alcohol containing hydroxyl group at its terminal and having up to several hundred carbon atoms, particularly up to about 100 carbon atoms; and an alkylene oxide-added alcohol. Fractionation of these waxes may preferably be performed by the press sweating method, the solvent method, vacuum distillation, supercritical gas extraction or fractional crystallization (e.g., fusion crystallization or crystal filtration) to provide a resultant wax with a sharp molecular weight distribution. As a result, such as wax shows a sharp heat absorption peak on a DSC curve on temperature increase as measured by a differential scanning calorimeter, thus suitably constituting a wax component exhibiting a desired fusion (melting) behavior.

In the present invention, at least two species of fractionated waxes as described above may preferably be used as a wax component to be incorporated in toner particles showing improved and balanced performances in respects of the low-temperature fixability, the anti-blocking characteristic and the high-temperature anti-offset characteristic because the use of at least two fractionated waxes is effective in providing a resultant wax component with a desired melting behavior.

Further, the above fractionation methods may preferably be adopted in combination of two or more species (e.g., vacuum distillation under an ultrahigh vacuum environment is performed after a wax as described above is fractionated by fractional crystallization) in order to narrow a temperature range of a maximum heat absorption peak on temperature increase on a DSC curve measured by using the DSC. By incorporating two or more species of such waxes showing different maximum heat absorption peaks into toner particles, the resultant toner may more preferably be improved in stability of image density while retaining a good dispersibility of the wax component in the toner.

The incorporation of the wax component into the toner may be performed by, e.g., the following methods (1) to (3).

(1) Toner ingredients including a wax component, a binder resin, a colorant (or a magnetic material), and optional other additives are sufficiently blended by a blender, such as a ball mill, melted and kneaded by hot kneading means, such as hot rollers, a kneader or an extruder to cause mutual melting of the wax and resinous components, cooled and solidified, and then pulverized.

(2) In case where two or more species of waxes ar incorporated in a toner, the waxes are melt-blended with each other under stirring at a temperature equal to or above their melting temperatures in advance, cooled, solidified and pulverized. Thus, the resultant pulverized wax component is subjected to the above method (1).

(3) A binder resin is dissolved in a solvent to form a resin solution, followed by heating. A wax component is added to and mixed with the heated resin solution under stirring, followed by distilling-off of the solvent, drying and pulverization. Then, the resultant pulverized wax component is subjected to the above method (1).

The above methods (2) and (3) may preferably be used in respect of dispersibility of the wax component in the toner particles. Further, the method (3) may particularly be excellent in production stability.

In case where two or more species of the above-described wax(es) are used, one wax may preferably have a half-width termination temperature of a heat absorption peak (defined hereinafter) in a temperature region of 60°–100° C. on a DSC curve on temperature increase as measured by using the DSC, and another wax may preferably have a half-width initiation temperature of a heat absorption peak (defined hereinafter) in a temperature region of 90°–140° C. In this instance, the former wax may preferably be used in an amount of 0.1–15 wt. parts, more preferably 0.5–10 wt. parts, per 100 wt. parts of the binder resin. The latter wax may preferably be used in an amount of 0.1–12 wt. parts, more preferably 0.5–10 wt. parts, per 100 wt. parts of the binder resin. It is possible to use other waxes different from the above waxes in an amount of 0.1–10 wt. parts, preferably 0.5–7 wt. parts, as desired.

By using the wax component in the above-described amount, it is possible to effectively improve the low-temperature fixability.and the anti-offset characteristic without impairing the anti-blocking characteristic.

In the present invention, the wax component may preferably be contained in the toner in a total amount of 0.2–20 wt. parts, particularly 0.5–10 wt. parts, per 100 wt. parts of the binder resin.

The DSC measurement for characterizing the present invention may preferably be performed by using an internal heating input compensation-type differential scanning calorimeter which shows a high accuracy based on the measurement principle. A commercially available example thereof is "DSC-7" (trade name) mfd. by Perkin-Elmer Corp.

Figure 4:
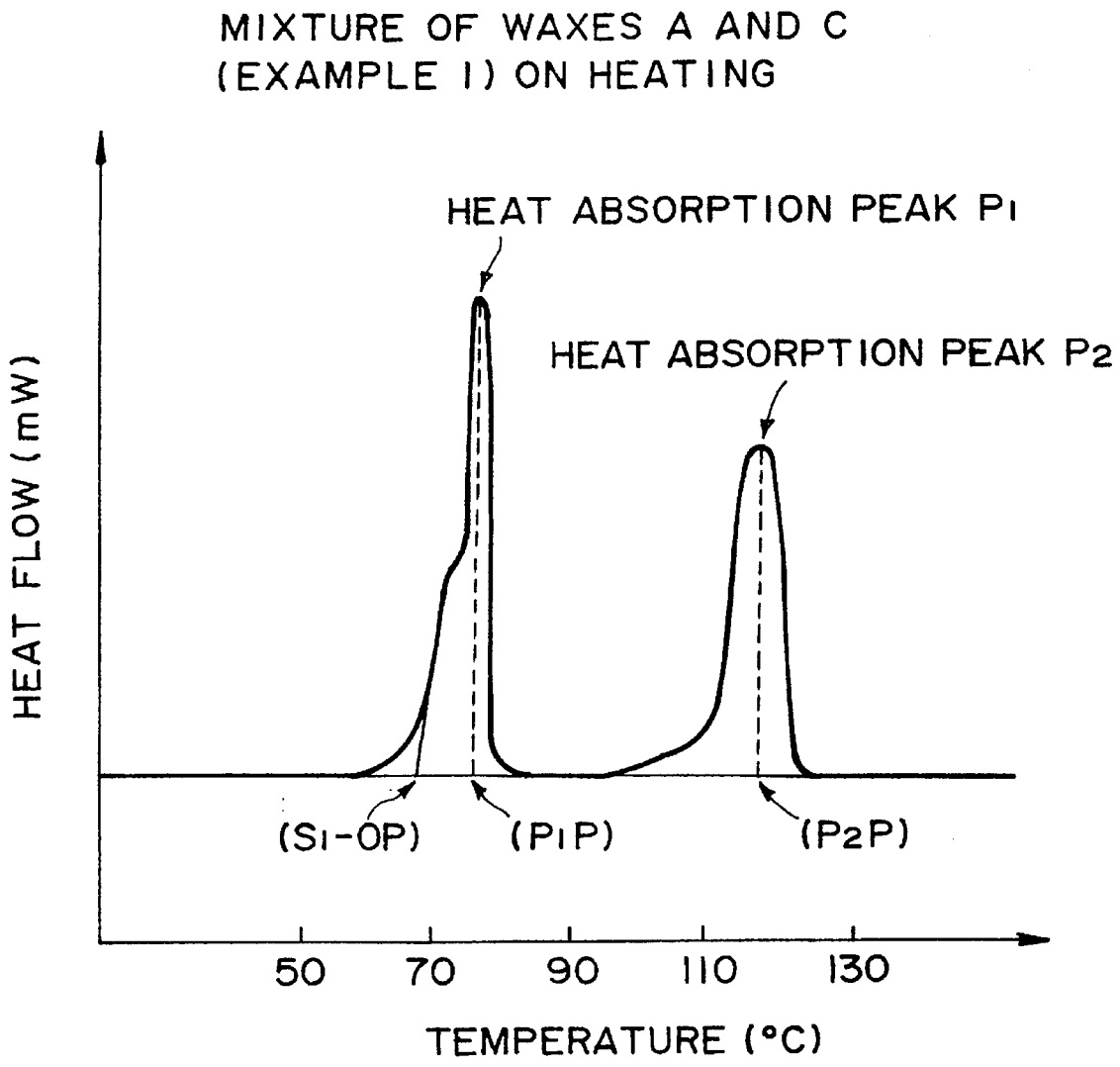
FIGS. 4 and 5 respectively show DSC curves on temperature decrease of a wax mixture of A and C (1:1) used in Toner No. 1 of Example 1 according to the present invention.
Figure 5:
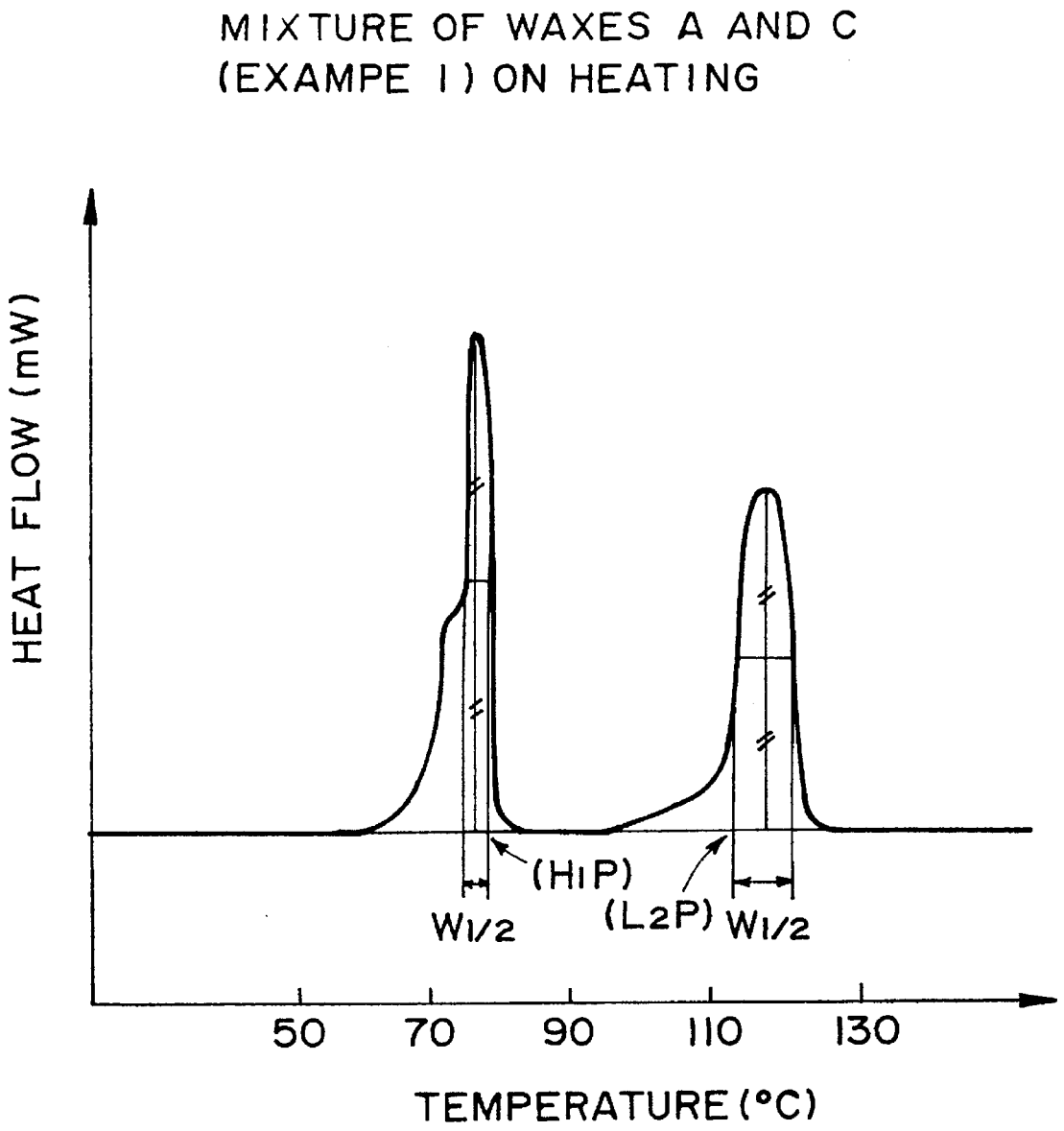
Figure 6:
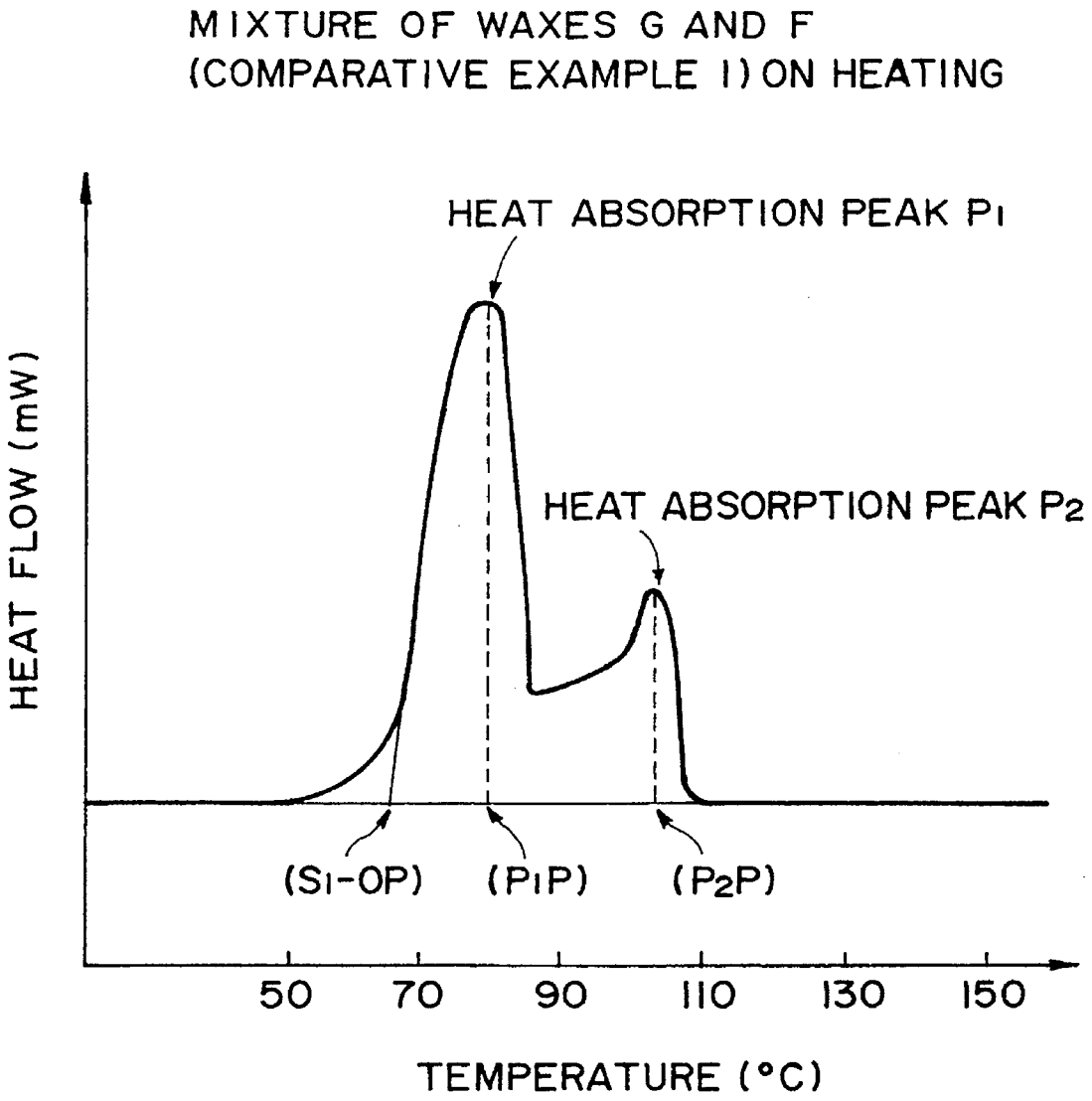
FIGS. 6 and 7 each show a DSC curve on temperature increase of a wax mixture of G and F (1:1) used in Toner No. 10 of Comparative Example 1.

The measurement may be performed according to ASTM D3418-82. Before a DSC curve is taken, a sample (wax) is once heated and cooled for removing its thermal history and then subjected to heating (temperature increase) at a rate of 10° C./min. in a prescribed temperature range for taking DSC curves. The temperatures or parameters characterizing the invention are defined as follows. Absorbed heat is taken in the positive (or upward) direction. Specific examples of such temperatures or parameters are shown in FIGS. 4 and 5 (for a wax mixture (A and C) of Example 1 appearing hereinafter) and FIGS. 6 and 7 (for a wax mixture (G and F) of Comparative Example 1), respectively.

(a) Minimum onset temperature of heat absorption peak ($S_1$-OP) is a minimum temperature between or among temperatures each at which a tangential line taken at a point giving the largest differential on a peak curve on temperature increase intersects the base line.

(b) Maximum (largest) heat absorption peak is a heat absorption peak having a maximum height from the base line to a peak top on a peak curve on temperature increase.

(c) Second largest heat absorption peak is a heat absorption peak next to the maximum heat absorption peak in height (a heat absorption peak having the second largest height) between or among heat absorption peaks at temperatures at least 15° C. distant from a temperature giving the maximum heat absorption peak (or at temperatures different from a temperature giving the maximum heat absorption peak by at least 15° C.) on a DSC curve.

(d) Peak temperature of lower temperature (heat absorption) peak $P_1$ ($P_1P$) is a temperature at which a heat absorption peak $P_1$ located in a lower temperature region between the maximum and the second largest heat absorption peaks assumes a peak top on temperature increase.

Figure 2:
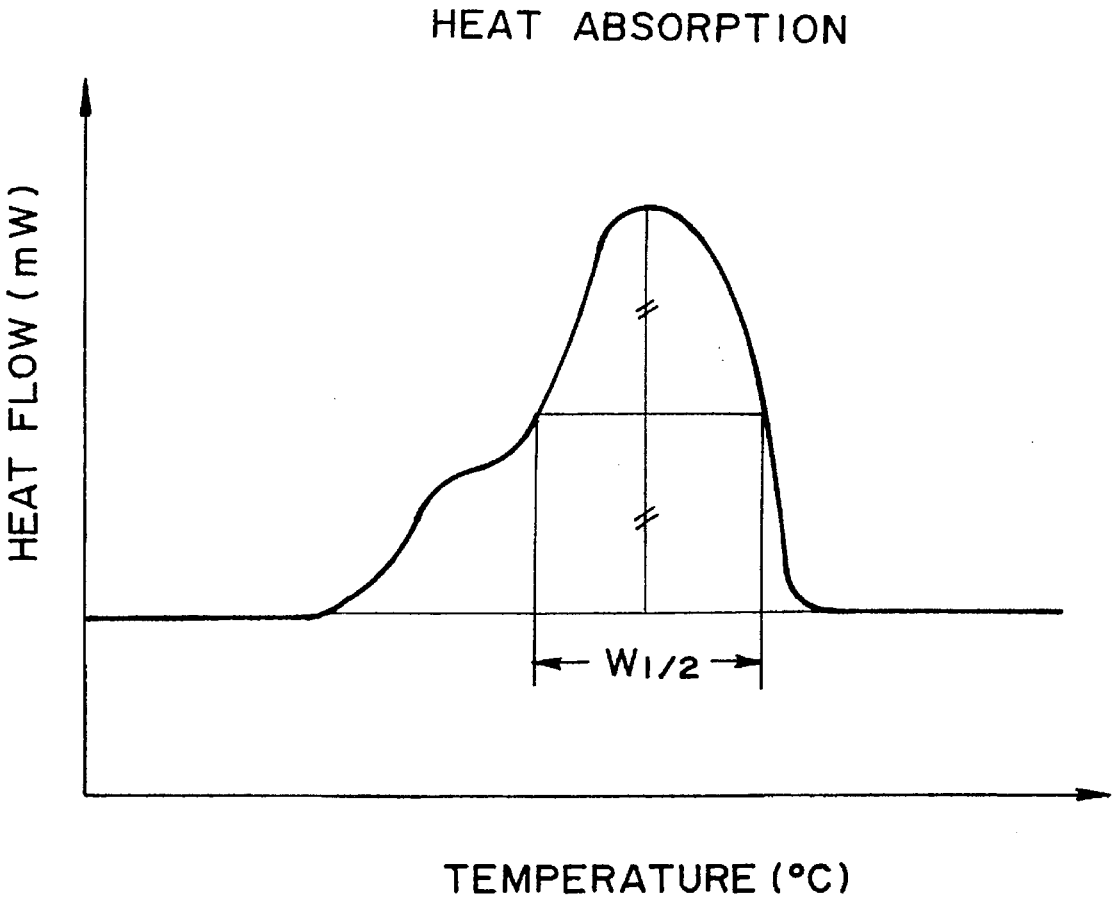
Figure 3:
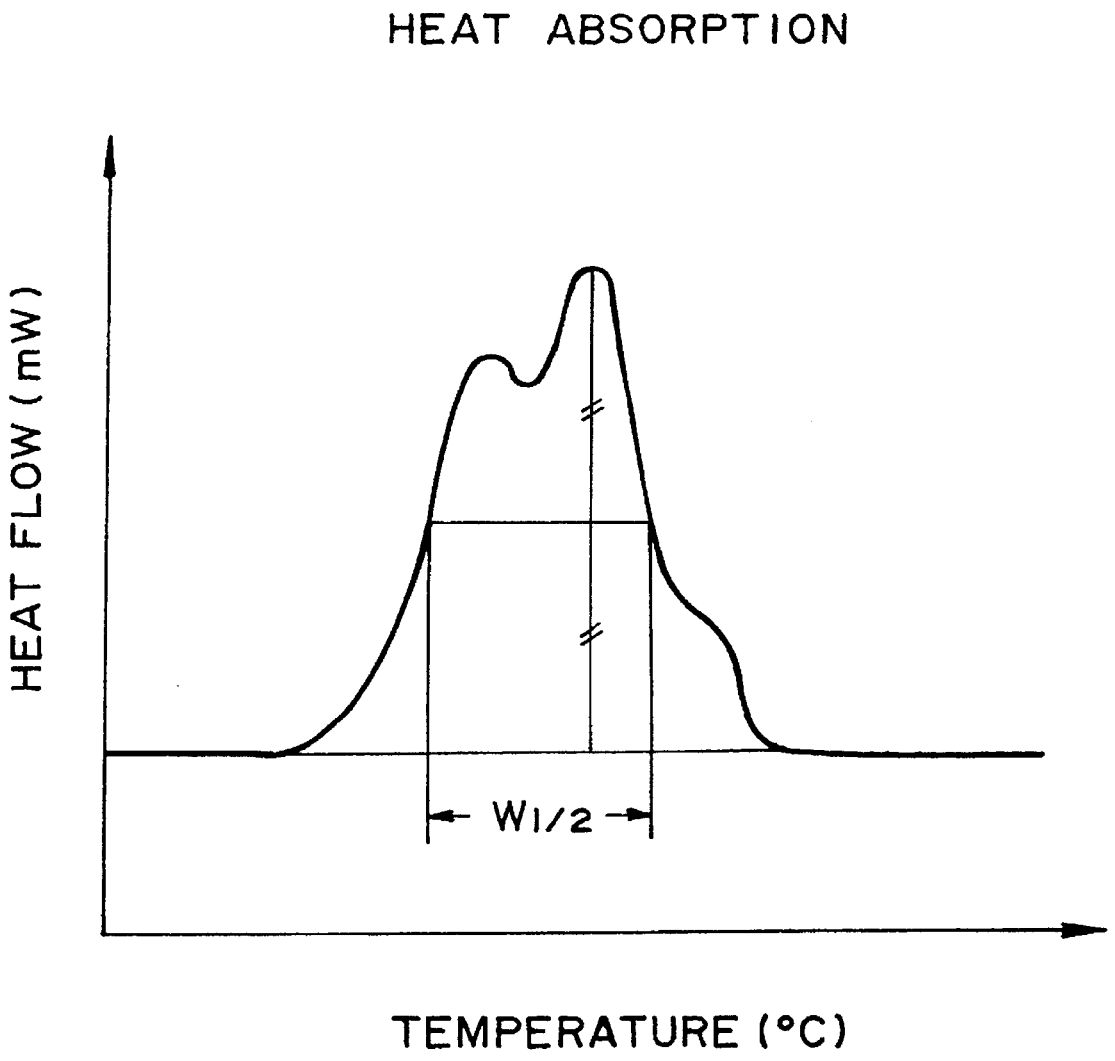

(e) Half-value width (or Half-width) $W_{1/2}$ of lower temperature (heat absorption) peak $P_1$ is a temperature difference (temperature range) over which a heat absorption peak spans at a half height of a heat absorption peak in a lower temperature region. If plural heat absorption peaks giving $W_{1/2}$ as a whole are continuously present above the base line, the plural heat absorption peaks must have a height equal to or exceeding the half height all over the half-(value) width $W_{1/2}$. If two or more heat absorption peaks have a height of below the half height at at least one temperature in the half-width ($W_{1/2}$) region, such heat absorption peaks are regarded as different peaks from each other (FIG. 1). Specific examples for taking $W_{1/2}$ are shown in FIGS. 1–3.

(f) Termination temperature of heat absorption peak half-width (higher half-width temperature) in lower temperature region ($H_1P$) is a temperature at which a temperature range (difference) of a half-width ($W_{1/2}$) in a lower temperature region is terminated or ended on a peak curve on temperature increase. $H_1P$ may preferably be present in a temperature range of 60°–100° C.

(g) Peak temperature of higher temperature (heat absorption) peak $P_2$ ($P_2P$) is a temperature at which a heat absorption peak $P_2$ located in a higher temperature region between the largest and the second largest heat absorption peaks assumes a peak top on temperature increase.

(h) Half-(value) width $W_{1/2}$of higher temperature (heat absorption) peak $P_2$ is defined similarly as in the above (e).

(i) Initiation temperature of heat absorption peak half-width (lower half-width temperature) in higher temperature region (L2P) is a temperature at which a temperature range (difference) of a half-width ($W_{1/2}$) in a higher temperature region is initiated or started on a peak curve on temperature increase. $L_2P$ may preferably be present in a temperature range of 90°–140° C.

In the present invention, the wax component may preferably provide a DSC curve on temperature increase (as measured by the DSC) showing a lower temperature peak $P_1$ as a maximum (or the largest) heat absorption peak and a higher temperature peak $P_2$ as the second largest heat absorption peak. In this instance, a low-melting point wax may preferably be used for giving the lower temperature peak $P_1$ and a high-melting point wax may preferably be used for giving the higher temperature peak $P_2$.

The low-melting point wax for giving the lower temperature peak $P_1$ may preferably provide a maximum heat absorption peak in a temperature range of 55°–90° C. (more preferably 60°–85° C.) and a half-width of at most 20° C. (more preferably at most 10° C). On the other hand, the high-melting point wax for giving the higher temperature peak $P_2$ may preferably provide a maximum heat absorption peak in a temperature range of above 90° C. to 150° C. (more preferably 95°–130° C.) and a half-width of at most 20° C. (more preferably at most 15° C.). The low-melting point wax and the high-melting point wax may preferably show a difference in maximum heat absorption peak temperature therebetween of 15°–95° C. (more preferably 35°–70° C.) in view of function separation.

The binder resin for the toner of the present invention may for example be composed of: homopolymers of styrene and derivatives thereof, such as polystyrene, poly-p-chlorostyrene and polyvinyltoluene; styrene copolymers such as styrene-p-chlorostyrene copolymer, styrene-vinyltoluene copolymer, styrene-vinylnaphthalene copolymer, styrene-acrylate copolymer, styrene-methacrylate copolymer, styrene-methyl-α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer and styrene-acrylonitrile-indene copolymer; polyvinyl chloride, phenolic resin, natural resin-modified phenolic resin, natural resin-modified maleic acid resin, acrylic resin, methacrylic resin, polyvinyl acetate, silicone resin, polyester resin, polyurethane, polyamide resin, furan resin, epoxy resin, xylene resin, polyvinyl butyral, terpene resin, chmarone-indene resin and petroleum resin.

Preferred classes of the binder resin may include styrene copolymers and polyester resins.

Examples of the comonomer constituting such a styrene copolymer together with styrene monomer may include other vinyl monomers inclusive of: monocarboxylic acids having a double bond and derivatives thereof, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and derivatives thereof, such as maleic acid, butyl maleate, methyl maleate and dimethyl maleate; vinyl esters, such as vinyl chloride, vinyl acetate, and vinyl benzoate; ethylenic olefins, such as ethylene, propylene and butylene; vinyl ketones, such as vinyl methyl ketone and vinyl hexyl ketone; and vinyl ethers, such as vinyl methyl ether, vinyl ethyl ether, and vinyl isobutyl ether. These vinyl monomers may be used alone or in mixture of two or more species in combination with the styrene monomer.

It is possible that the binder resin inclusive of styrene polymers or copolymers has been crosslinked or can assume a mixture of crosslinked and un-crosslinked polymers.

The crosslinking agent may principally be a compound having two or more double bonds susceptible of polymerization, examples of which may include: aromatic divinyl compounds, such as divinylbenzene, and divinylnaphthalene; carboxylic acid esters having two double bonds, such as ethylene glycol diacrylate, ethylene glycol dimethacrylate and 1,3-butanediol dimethacrylate; divinyl compounds, such as divinylaniline, divinyl ether, divinyl sulfide and divinylsulfone; and compounds having three or more vinyl groups. These may be used singly or in mixture of two or more species.

The binder resin may for example be prepared by bulk polymerization, solution polymerization, suspension polymerization, emulsion polymerization, etc.

In the bulk polymerization, it is possible to obtain a low-molecular weight polymer by performing the polymerization at a high temperature so as to accelerate the termination reaction, but there is a difficulty that the reaction control is difficult. In the solution polymerization, it is possible to obtain a low-molecular weight polymer or copolymer under moderate conditions by utilizing a radical chain transfer function depending on a solvent used or by selecting the polymerization initiator or the reaction temperature. Accordingly, the solution polymerization is preferred for preparation of a low-molecular weight polymer or copolymer used in the binder resin of the present invention.

The solvent used in the solution polymerization may for example include xylene, toluene, cumene, cellosolve acetate, isopropyl alcohol, and benzene. It is preferred to use xylene, toluene or cumene for a styrene monomer or a mixture of a styrene monomer with another monomer.

The reaction temperature may depend on the solvent and polymerization initiator used and the monomer or comonomer to be polymerized but may generally suitably be in the range of 70°–230° C. In the solution polymerization, it is preferred to use 30–400 wt. parts of a monomer (mixture) per 100 wt. parts of the solvent. It is also preferred to mix one or more other polymers in the solution after completion of the polymerization, thus providing a uniform polymer mixture.

In order to produce a high-molecular weight polymer component or a gel component, the emulsion polymerization or suspension polymerization may preferably be adopted.

Of these, in the emulsion polymerization method, a monomer almost insoluble in water is dispersed as minute particles in an aqueous phase with the aid of an emulsifier and is polymerized by using a water-soluble polymerization initiator. According to this method, the control of the reaction temperature is easy, and the termination reaction velocity is small because the polymerization phase (an oil phase of the vinyl monomer possibly containing a polymer therein) constitute a separate phase from the aqueous phase. As a result, the polymerization velocity becomes large and a polymer having a high polymerization degree can be prepared easily. Further, the polymerization process is relatively simple, the polymerization product is obtained in fine particles, and additives such as a colorant, a charge control agent and others can be blended easily for toner production.

In the emulsion polymerization, however, the emulsifier used is liable to be incorporated as an impurity in the polymer produced, and it is necessary to effect a post-treatment such as salt-precipitation in order to recover the product polymer from the aqueous phase. The suspension polymerization is more convenient in this respect.

The suspension polymerization may preferably be performed by using at most 100 wt. parts, preferably 10–90 wt. parts, of a monomer (mixture) per 100 wt. parts of water or an aqueous medium. The dispersing agent usable therefor may include polyvinyl alcohol, partially saponified form of polyvinyl alcohol, and calcium phosphate, and may generally be used in an amount of 0.05–1 wt. part per 100 wt. parts of the aqueous medium. The polymerization temperature may suitably be in the range of 50°–95° C. and selected depending on the polymerization initiator used and the objective polymer. The polymerization initiator should be insoluble or hardly soluble in water.

Examples of the polymerization initiator may include: t-butylperoxy-2-ethylhexanoate, cumyl perpivalate, t-butyl peroxylaurate, benzoyl peroxide, lauroyl peroxide, octanoyl peroxide, di-t-butyl peroxide, t-butylcumul peroxide, dicumul peroxide, 2,2'-azobisisobutylonitrile, 2,2'-azobis(2-methyl-butyronitrile, 2,2'-azobis(2,4-dimethylvaleronitrile), 2,2'-azobis(4-methoxy-2,4-dimethylvaleronitrile), 1,1-bis(t-butylperoxy)-3,3,5-trimethylcyclohexane, 1,1-bis(t-butylperoxy)cyclohexane, 1,4-bis(t-butylperoxycarbonyl)cyclohexane, 2,2-bis(t-butylperoxy)octane, n-butyl-4,4-bis(t-butylperoxy)valerate, 2,2-bis(t-butylperoxy)butane, 1,3-bis(t-butylperoxyisopropyl)benzene, 2,5-dimethyl-2,5-di(t-butylperoxy)hexane, 2,5-dimethyl-2,5-di(benzoylperoxy)hexane, di-t-butyldiperoxyisophthalate, 2,2-bis(4,4-di-t-butyl-peroxycyclohexyl)propane, di-t-butylperoxy-α-methylsuccinate, di-t-butylperoxy-dimethylglutarate, di-t-butylperoxyhexahydro-terephthalate, di-t-butylperoxyazelate, 2,5-dimethyl-2,5-di-(t-butylperoxy)hexane, diethylene glycol-bis(tbutylperoxycarbonate), di-t-butylperoxytrimethylazipate, tris(t-butylperoxy)triazine, and vinyl-tris(t-butylperoxy)silane. These initiators may be used singly or in combination.

The polymerization initiator may preferably be used in an amount of at least 0.05 wt. part, more preferably 0.1–15 wt. parts, per 100 wt. parts of the monomer (mixture).

The polyester resin for the binder resin used in the present invention may comprise an alcohol component and an acid component.

Examples of a dihydric alcohol component may include: diols, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenol and derivatives thereof represented by the following formula (A):

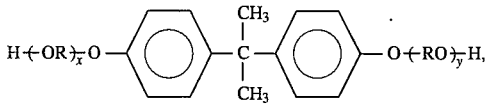

(A)

wherein R denotes an ethylene or propylene group, x and y are independently 0 or a positive integer with the proviso that the average of x+y is in the range of 0–10; and diols represented by the following formula (B):

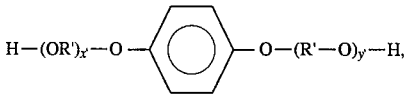

(B)

wherein R' denotes

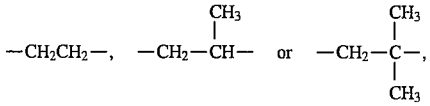

x' and y' are independently a positive integer with the proviso that the average of x'+y' is in the range of 1–10.

Examples of a dibasic acid component may include: benzenedicarboxylic acids and their anhydrides, such as phthalic acid, terephthalic acid, isophthalic acid, and phthalic anhydride; dicarboxylic acids, such as succinic acid, adipic acid, sebacic acid and azelaic acid, and their anhydrides; alkyl or alkenyl-substituted succinic acids, such as n-dodecenyl succinic acid and n-dodecyl succinic acid, and their anhydrides; unsaturated dicarboxylic acids, such as fumaric acid, maleic acid, citraconic acid and itaconic acid, and their anhydrides; and lower alkyl-substituted esters of the above acids.

In the present invention, it is possible to use an alcohol component and/or acid component each having at least three functional groups in combination with the above-mentioned dihydric alcohol component and dibasic acid component. The alcohol component and acid component each having at least three functional groups may also function as a crosslinking component.

Examples of the alcohol component having three or more hydroxyl groups may include: sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxybenzene.

Examples of the acid component having three or more carboxylic groups may include: trimellitic acid, pyromellitic acid, 1,2,4-benzenetricarboxylic acids, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxylpropane, tetra(methylenecarboxyl)methane, 1, 2, 7, 8-octanetetracarboxylic acid, trimer acids and their anhydrides and lower alkyl esters; and tetracarboxylic acids represented by the following formula:

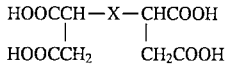

wherein X denotes an alkylene or alkenylene group having 5–30 carbon atoms and including at least one side chain having 3 or more carbon atoms.

The polyester resin for the binder resin used in the present invention may preferably comprise 40–60 mol. %, more preferably 45–55 mol. %, of alcohol component and 60–40 mol. %, more preferably 55-45 mol. %, of acid component. The alcohol component having three or more hydroxyl groups may preferably occupy 1–60 mol. % per the total alcohol component and the acid component having three or more carboxylic groups may preferably occupy 1–60 mol. % per the total acid component.

The binder resin for the toner according to the present invention may preferably comprise styrene-unsaturated carboxylic acid derivative copolymer, polyester resin, block copolymer or grafted product of these resins (polymers), and a polymer mixture of styrene-based copolymer and polyester resin in respects of the developing performance, fixability, durability and cleaning performance.

The binder resin, in case where a toner of the present invention is a positively chargeable toner, may preferably include: styrene-acrylate (or acrylic acid) copolymer, styrene-methacrylate (or methacrylic acid)-acrylate (or acrylic acid) copolymer, styrene-methacrylate (or methacrylic acid) copolymer, styrene-butadiene copolymer, polyester resin, and block copolymer, grafted product and polymer blend of these copolymers or resins, in respects of developing performances.

The binder resin, in case where a toner of the present invention is a negatively chargeable toner, may preferably include: styrene-acrylate (or acrylic acid) copolymer, styrshe-methacrylate (or methacrylic acid)-acrylate (or acrylic acid) copolymer, styrshe-methacrylate (or methacrylic acid) copolymer, copolymer obtained by using corresponding monomers of these with maleic acid monoester, polyester resin, and block copolymer, grafted product and polymer blend of these copolymers or resins, in respects of developing performances.

In case where a toner for heat fixation is prepared by using a styrene copolymer as a binder resin, the toner may preferably have a molecular weight distribution described below in order to prevent lowering in anti-blocking characteristic and developing performances attributable to a plasticizing effect thereof while sufficiently exhibiting its preferable effect.

The toner may preferably show a molecular weight distribution on its GPC chromatogram providing at least one peak in a lower molecular weight region of $3\times10^3$–$5\times10^4$, more preferably $3\times10^3$—$3\times10^4$, particularly preferably $5\times10^3$ - $2\times10^4$, whereby it is possible to attain good performances in respects of the fixability, developing performance and anti-blocking characteristic.

It is preferred that at least one peak is present in a higher molecular weight region of at least $10^5$, preferably $3\times10^5$–$5\times10^6$, and it is particularly preferred that the largest peak in the molecular weight region of at least $10^5$ is present in the limited molecular weight region of $3\times10^5$ - $2\times10^6$ so as to provide a good anti-offset characteristic at high temperatures, a good anti-blocking characteristic and an excellent developing performance. A larger peak molecular weight in this region leads to a better anti-offset at high temperatures and may be suitably used when used in combination with hot rollers capable of applying a high pressure but can adversely affect the fixability because of a large elasticity of the toner when used in combination with hot rollers not applying a high pressure. Accordingly, when used in combination with hot rollers applying a relatively low pressure, it is preferred that the largest peak in the higher molecular weight region of at least $10^5$ is present in the region of $3\times10^5$ - $2\times10^6$. The component in the lower molecular weight region of $10^5$ or below occupies at least 50%, preferably 60–90%, particularly preferably 65–85%. By satisfying this condition, a good fixability is exhibited. Below 50%, a fixability is lowered and also the pulverizability in toner production becomes inferior. Above 90%, the difficulties due to the plasticizing effect by the wax addition are liable to be caused.

In the case of using the polyester resin as a binder resin for the toner, the toner may preferably show a molecular weight distribution on its GPC chromatogram providing a main peak in a molecular weight region of $3\times10^3$ - $1.5\times10^4$, more preferably $4\times10^3$ - $1.2\times10^4$, particularly preferably $5\times10^3$ -$1\times10^4$.

Further it is preferred that at least one peak or shoulder is present in a molecular weight region of at least $1.5\times10^4$ or the component in the molecular weight region of at least $5\times10^4$ occupies at least 5%. The polyester resin may preferably have a ratio of a weight-average molecular weight (Mw) of a number-average molecular weight (Mn).(i.e., Mw/Mn) of at least 10.

If the main peak is present in a molecular weight region of below $3\times10^3$ the toner is liable to be adversely affected by the plasticizing effect due to the wax addition, thus being liable to lower the anti-blocking characteristic and the developing performance. Above $1.5\times10^4$ the toner is liable to be lowered in its fixability. In cases where the peak or shoulder is present in the molecular weight region of at least $1.5\times10^4$ where the component in the molecular weight region of at least $5\times10^4$ occupies 5%, and where the ratio of Mw/Mn is at least 10 as described above, it is possible to suppress the difficulties caused by the plasticizing effect of the wax component added.

In the present invention, the molecular weight distribution by GPC (gel permeation chromatography) of the toner may be measured by using THF (tetrahydrofuran) in the following manner.

A GPC sample is prepared as follows.

A resinous sample is placed in THF and left standing for several hours (e.g., 5–6 hours). Then, the mixture is sufficiently shaked until a lump of the resinous sample disappears and then further left standing for more than 12 hours (e.g., 24 hours) at room temperature. In this instance, a total time of from the mixing of the sample with THF to the completion of the standing in THF is taken for at least 24 hours (e.g., 24–30 hours). Thereafter, the mixture is caused to pass through a sample treating filter having a pore size of 0.45–0.5 μm (e.g., "Maishoridisk H-25-5", available from Toso K. K.; and "Ekikurodisk 25CR", available from German Science Japan K.K.) to recover the filtrate as a GPC sample. The sample concentration is adjusted to provide a resin concentration within the range of 0.5–5 mg/ml.

In the GPC apparatus, a column is stabilized in a heat chamber at 40° C., tetrahydrofuran (THF) solvent is caused to flow through the column at that temperature at a rate of 1 ml/min., and about 100 μl of a GPC sample solution is injected. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be those having molecular weights in the range of about $10^2$ to $10^7$ available from, e.g., Toso K. K. or Showa Denko K. K. It is appropriate to use at least 10 standard polystyrene samples. The detector may be an RI (refractive index) detector. For accurate measurement, it is appropriate to constitute the column as a combination of several commercially available polystyrene gel columns. A preferred example thereof may be a combination of Shodex GPC KF-801, 802, 803, 804, 805, 806, 807 and 800P; or a combination of TSK gel G1000H ($H_{XL}$), G2000H ($H_{XL}$), G3000H ($H_{XL}$), G4000H ($H_{XL}$), G5000H ($H_{XL}$), G6000H ($H_{XL}$), G7000H ($H_{XL}$) and TSK guardcolumn available from Toso K. K.

The toner according to the present invention may further contain a resinous substance in addition to the above-described binder resin in an amount not exceeding the content of the binder resin. Such a resinous substance may include silicone resin, polyurethane, polyamide, epoxy resin, polyvinylbutyral, rosin, modified rosin, terpene resin, phenolic resin, and copolymer of at least two α-olefins.

The toner of the present invention can further contain a positive or negative charge control agent.

Examples of the positive charge control agents may include: nigrosine and modified products thereof with aliphatic acid metal salts, etc., onium salts inclusive of quarternary ammonium salts, such as tributylbenzylammonium 1-hydroxy-4-naphtholsulfonate and tetrabutylammonium tetrafluoroborate, and their homologous inclusive of phosphonium salts, and lake pigments thereof; triphenylmethane dyes and lake pigments thereof (the laking agents including, e.g., phosphotungstic acid, phosphomolybdic acid, phosphotungsticmolybdic acid, tannic acid, lauric acid, gallic acid, ferricyanates, and ferrocyanates); higher aliphatic acid metal salts; diorganotin oxides, such as dibutyltin oxide, dioctyltin oxide and dicyclohexyltin oxide: diorganotin borates, such as dibutyltin borate, dioctyltin borate and dicyclohexyltin borate; guanidine compounds; and triphenylmethane compounds. These may be used singly or in mixture of two or more species. Among these, triphenylmethane compounds and quarternary ammonium salts free from halogen as a counter ion are preferred.

It is also possible to use a homopolymer of a monomer represented by the following formula (1):

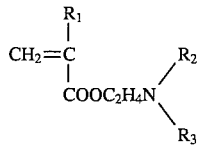

(1)

wherein $R_1$ is H or $CH_3$, and $R_2$ and $R_3$ each is a substituted and unsubstituted alkyl group (preferably having 1–4 carbon atoms), or a copolymer of the above monomer with another (polymerizable) monomer described above, such as styrene, acrylate or methacrylate, as the positive charge control agent. In this case, the homopolymer or the copolymer may function as both of the charge control agent and (a part of or total of) the binder resin.

In the present invention, as the positive charge control agent, it is particularly preferred to use a triphenylmethane compound represented by the following formula (2):

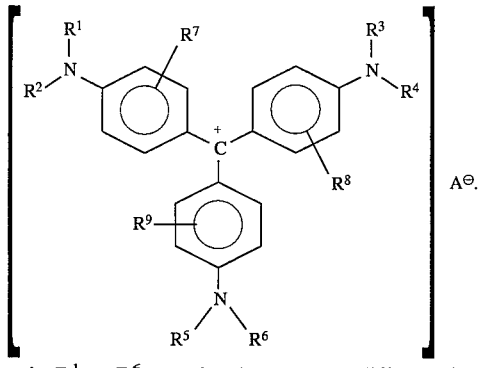

(2)

wherein $R^1$ to $R^6$ may be the same or different from each other and independently represent hydrogen, a substituted or unsubstituted alkyl group or a substituted or unsubstituted aryl group; $R^7$ to $R^9$ may be the same or different from each other and independently represent hydrogen, halogen, alkyl group or alkoxy group; and $A^{\ominus}$ represents an anion, such as sulfate ion, nitrate ion, borate ion, phosphate ion, hydroxyl ion, organic sulfate ion, organic sulfonate, organic phosphate ion, carboxylate ion, organic borate ion or tetrafluoroborate.

Examples of the negative charge control agent may include: organic metal complexes and chelate compounds inclusive of monoazo metal complexes acetylacetone metal complexes, and organometal complexes of aromatic hydroxycarboxylic acids and aromatic dicarboxylic acids. Other examples may include: aromatic hydroxycarboxylic acids, aromatic mono- and poly-carboxylic acids, and their metal salts, anhydrides and esters, and phenol derivatives, such as bisphenols. Among the above, a monoazo metal complex represented by the formula (3) below is preferred.

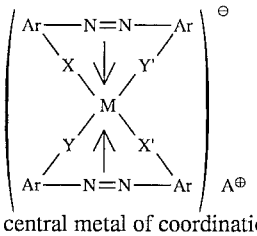

(3)

wherein M is a central metal of coordination, such as Sc, Ti, V, Cr, Co, Ni, Mn or Fe; Ar is an aryl group, such as phenyl or naphthyl, capable of having a substituent, such as nitro group, halogen, carboxyl group, anilide group, an alkyl group having 1–18 carbon atoms, or an alkoxy group having 1–18 carbon atoms; X, X', Y and Y' independently denote —O—, —CO—, —NH— or —NR— (R=$C_{1-4}$ alkyl); and $A^{\oplus}$ is hydrogen, ion, sodium ion, potassium ion, ammonium ion, aliphatic ammonium ion, or an ion mixture of these ions.

In the above formula (3), M may preferably be Fe or Cr and the substituent for Ar group may preferably be halogen, alkyl group or anilide group. Further, the counter ion. $A^{\oplus}$ may preferably be hydrogen ion, alkaline metal ion, ammonium ion or aliphatic ammonium ion. In addition, a mixture of complex salts having different counter ions may preferably be used.

As the negative charge control agent, it is also preferred to use a basic organic acid metal complex represented by the following formula (4):

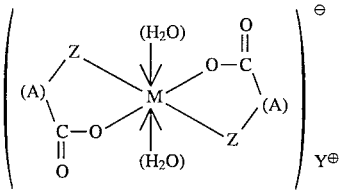

(4)

wherein M is a central metal of coordination, such as Cr, Co, Ni Mn, Fe, Zn, A1 Si or B; A is

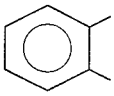

(optionally having an alkyl substituent),

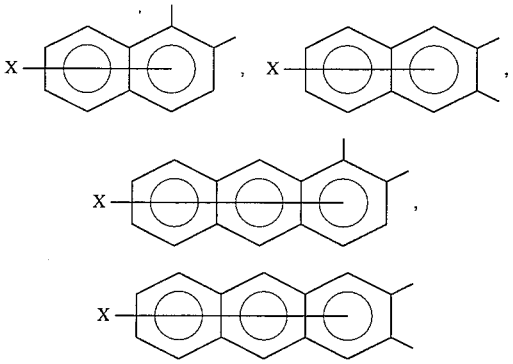

(where X is hydrogen, halogen, nitro group or alkyl group) and

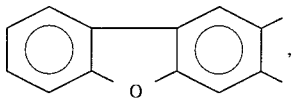

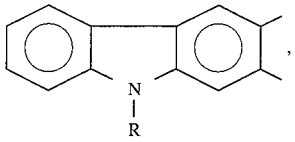

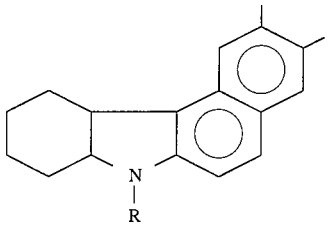

(where R is hydrogen or $C_{1-18}$ alkyl or alkenyl group); $Y^{\oplus}$ is hydrogen ion, sodium ion, potassium ion, ammonium ion, aliphatic ammonium ion or an ion mixture of these ions; and Z is —O— or $$-\overset{\overset{\displaystyle O}{\|}}{C}-O-.$$

Iin the above formula (4), M may preferably be the substituent for A may preferably be alkyl group, anilide group, aryl group or halogen. Further, the counter ion $Y^{\oplus}$ may preferably be hydrogen ion, ammonium ion or aliphatic ammonium ion.

The above-mentioned charge control agent may be internally or externally added in toner particles in an appropriate amount while taking the type of the binder resin, presence or absence of other additives and a toner production method including a dispersion method into consideration. The charge control agent may preferably be contained in an amount of 0.1–10 wt. parts, more preferably 0.1–5 wt. parts, per 100 wt. parts of the binder resin.

It is preferred to use the toner according to the present invention together with silica fine powder externally blended with toner particles in order to improve the charge stability, developing characteristic fluidity and durability.

The silica fine powder used in the present invention provides good results if it has a specific surface area of 20 $m^2/g$ or larger, preferably 30–400 $m^2/g$, as measured by nitrogen adsorption according to the BET method. The silica fine powder may be added in a proportion of 0.01–8 wt. parts, preferably 0.1–5 wt. parts, per 100 wt. parts of the toner particles.

For the purpose of being provided with hydrophobicity and/or controlled chargeability, the silica fine powder may preferably have been treated with a treating agent, such as silicone varnish, modified silicone varnish, silicone oil, modified silicone oil, silane coupling agent, silane coupling agent having functional group or other organic silicon compounds. It is also preferred to use two or more treating agents in combination.

In order to improve the developing characteristic and durability of the toner, it is preferred to add an inorganic powder, examples of which may include: oxides of metals, such as magnesium, zinc, aluminum, cerium, cobalt, iron, zirconium, chromium, manganese, strontium, tin, and antimony; double oxides of metals, such as calcium titanate, magnesium titanate and strontium titanate; metal salts, such as calcium carbonate, magnesium carbonate, aluminum carbonate; clay mineral, such as kaolin; phosphate compounds, such as apatite; silicon compounds, such as silicon carbide and silicon nitride; and carbon powders, such as carbon black and graphite. Of these inorganic powders, fine powders of zinc oxide, aluminum oxide, cobalt oxide, manganese dioxide, strontium titanate and magnesium titanate may preferably be used.

The toner of the present invention may further contain a powder lubricant including: a fluorine-containing resin, such as polytetrafluoro-ethylene, or polyvinylidene fluoride; a fluorine-containing compound, such as carbon fluoride; a fatty acid metal salt, such as zinc stearate; fatty acid derivatives, such as fatty acid and fatty acid ester; and molybdenum sulfide.

The toner according to the present invention can be mixed with carrier particles to be used as a two-component developer. The carrier particles used for this purpose may be a known one. Specific examples of the carrier particles may include: particles of metals, such as iron which has been surface oxidized or has not been oxidized, nickel, cobalt, manganese, chromium and rare earth elements; particles of alloys of these metals; and particles of oxides of these metals. The carrier particles may generally have an average particle size of 20–300 μm. The surface of the carrier particles may preferably be coated or covered with resins, such as styrene resin, acrylic resin, silicone resin, fluorine-containing resin, and polyester resin.

The toner according to the present invention can be constituted as a magnetic toner containing a magnetic material in its particles. In this case, the magnetic material can also function as a colorant. Examples of the magnetic material may include: iron oxide, such as magnetite, hematite, and ferrite; metals, such as iron, cobalt and nickel, and alloys of these metals with other metals, such as aluminum, cobalt, copper, lead, magnesium, tin, zinc, antimony, beryllium, bismuth, cadmium, calcium, manganese, selenium, titanium, tungsten and vanadium; and mixtures of these materials.

The magnetic material may have an average particle size of at most 2 μm, preferably 0.1–0.5 μm. The magnetic material may preferably be contained in the toner in a proportion of 20–200 wt. parts, more preferably 40–150 wt. parts, per 100 wt. parts of the binder resin.

The toner according to the present invention can contain a colorant which may be an appropriate pigment or dye.

Examples of the pigment may include: carbon black, aniline black, acetylene black, Naphthol Yellow, Hansa Yellow, Rhodamine Lake, Alizarin Lake, red iron oxide, Phthalocyanine Blue, and Indanthrene Blue. These pigments are used in an amount sufficient to provide a required optical density of the fixed images, and may be added in a proportion of 0.1–20 wt. parts, preferably 0.2–10 wt. parts, per 100 wt. parts of the binder resin.

Examples of the dye may include: azo dyes, anthraquinone dyes, xanthene dyes, and methine dyes, which may be added in a proportion of 0.1–20 wt. parts, preferably 0.3–10 wt. parts, per 100 wt. parts of the binder resin.

The toner according to the present invention may be prepared through a process including: sufficiently blending the binder resin, a colorant or a magnetic material, the wax component, and an optional charge control agent and other additives, as desired, by means of a blender such as a Henschel mixer or a ball mill, melting and kneading the blend by means of hot kneading means, such as hot rollers, a kneader or an extruder to cause melting of the resinous materials (binder resin and wax component) and disperse or dissolve the colorant or the magnetic material therein, and cooling and solidifying the kneaded product, followed by pulverization and classification.

The thus obtained toner may be further blended with other external additives, as desired, sufficiently by means of a mixer such as a Henschel mixer to provide a toner for developing electrostatic images according to the present invention.

In the present invention, a particle size distribution of the toner may be measured in the following manner.

Coulter Multisizer II (available from Coulter Electronics Inc.) is used as an instrument for measurement, to which are connected an interface (available from Nikkaki K. K.) for providing a number-basis distribution and a volume-basis distribution, and a personal computer ("CX-1", available from Canon K. K.).

For measurement, a 1%-NaCl aqueous solution as an electrolytic solution is prepared by using a reagent-grade sodium chloride. Into 100 to 150 ml of the electrolytic solution, 0.1 to 5 ml of a surfactant (preferably an alkylbenzenesulfonic acid salt) is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of the volume-basis particle size and the number of the sample toner particles by using the above-mentioned Coulter Multisizer II with a 100 μm-aperture to calculate a volume-basis distribution and a number-basis distribution. From the results of the volume-basis distribution, a weight-average particle size of the toner sample is calculated.

Hereinbelow, the present invention will be described more specifically based on Examples.

Preparation of waxes

Waxes A to M used in Examples 1–9 and/or Comparative Examples 1–8 were prepared in the following manner.

Wax H of a relatively low molecular weight was prepared by polymerizing ethylene at a low pressure in the presence of a Ziegler catalyst, and wax A and wax B were prepared by fractional crystallization of the wax H for providing a sharp (or narrower)-molecular weight distribution (or a sharp heat absorption peak) to some extent and further by vacuum distillation of the fractionated wax H for providing a sharp molecular weight distribution. Wax G was prepared by fractional crystallization of hydrocarbon prepared by the Arge process for providing a sharp molecular weight distribution to some extent. Wax I having a higher molecular weight than the wax G was prepared by similar polymerization, and waxes C, D, E and F were prepared by vacuum distillation of the wax I so as to provide a sharp molecular weight distribution. Wax J was prepared by fractional crystallization and subsequent vacuum distillation of a paraffin wax ("Paraffin Wax 135°", available from Nippon Sekiyu K. K.) used as wax L for providing a sharp molecular weight distribution. Wax K was prepared by fractional crystallization and subsequent vacuum distillation of a polypropylene wax ("Viscol 550P", available from Sanyo Kasei K. K.) used as wax M for providing a sharp molecular weight distribution.

The properties of these waxes are summarized in Table 1 appearing hereinafter.

Resin Synthesis Example 1

In a four-necked frank equipped with a nitrogen gas-guiding pipe, a condenser, a stirrer and a thermometer, 200 wt. parts of xylene was placed, followed by heating up to 140° C. in nitrogen atmosphere and under stirring. In this state, a mixture of 84 wt. parts of styrene, 16 wt. parts of n-butyl acrylate, and 2 wt. parts of di-t-butyl peroxide (DTBP) as a polymerization initiator was added dropwise to the solvent (xylene) in 4 hours by using a continual tap funnel to complete polymerization, followed by distilling-off of the solvent to obtain a styrene copolymer A. The styrene copolymer A was subjected to measurement of molecular weight distribution according to GPC, whereby the styrene copolymer A showed a maximum in a molecular weight of 12,000 and an Mw/Mn ratio of 2.3.

Resin Synthesis Example 2

In the polymerization apparatus used in Resin Synthesis Example 1, a mixture of 300 wt. parts of 0.1 wt. %-polyvinyl alcohol aqueous solution, 80 wt. parts of styrene, 20 wt. parts of n-butyl acrylate, and 0.2 wt. part of 2,2-bis(4,4-di-t-butylperoxycyclohexyl)propane as a polymerization initiator is placed and heated to 90° C., followed by polymerization at 90° C. for 24 hours. After the polymerization, the polymerized product was cooled, washed with water and dried to obtain a styrene copolymer B. As a result of measurement of molecular weight distribution by GPC, the styrene copolymer B showed a maximum in a molecular weight of 720,000 and an Mw/Mn ratio of 3.6.

The thus prepared styrene copolymers A and B were mixed in xylene in a weight ratio of 85:25 to obtain a binder resin-1.

Example 1

| | |
|---|---|
| Binder resin-1 | 100 wt. parts |
| Triiron tetroxide (average particle size = c.a. 0.2 μm) | 80 wt. parts |
| Triphenylmethane dye (positive charge control agent) | 2 wt. parts |
| Wax A | 2 wt. parts |
| Wax C | 2 wt. parts |

The above ingredients were blended preliminary and melt-kneaded through a twin-screw kneading extruder at 110° C. The kneaded product was cooled, coarsely crushed by a cutter mill, finely pulverized by a fine pulverizer using jet air stream, and classified by a melti-division classifier utilizing Coanda effect to obtain a positively chargeable magnetic toner No. 1 having a weightaverage particle size of 8.0 μm. 100 wt. part of the toner No. 1 was externally blended with 0.6 wt. part of positively chargeable hydrophobic colloidal silica fine powder to prepare a positively chargeable magnetic toner.

The properties of a mixture of wax A and wax C are shown in Table 2 appearing hereinbelow.

The magnetic toner prepared above was subjected to several tests including fixing and anti-offset characteristic tests, developing performance test, and anti-blocking characteristic test to evaluate toner performance.

As a result, the toner showed a good low-temperature fixability and a good anti-offset characteristic at low and high temperatures. The toner was of no problem with respect to an anti-blocking characteristic. Further, the toner provided a high image density without using an electrostatic offset phenomenon and melt-sticking onto a photosensitive drum surface. The results are shown in Table 3 appearing hereinafter.

Each of the above tests for evaluating performances of the toner was performed specifically in the following manners.

Fixing and anti-offset characteristic test

The toner was charged in a commercially available electrophotographic copying machine ("NP-4835", mfd. by Canon K. K.), including an OPC (organic photoconductor) photosensitive drum and remodeled so as to detach a fixing device equipped with a hot roller having a surface layer formed of PFA resin, to obtain yet-unfixed images. The yet-unfixed images were then subjected to fixing test and anti-offset test by passing through an external hot roller fixing device capable of temperature control into which the above fixing device detached from the copying machine ("NP-4835") had been remodeled under the conditions of a nip =4.0 mm and a process speed =150 mm/sec within a temperature range of 100°–240° C. at an increment of 5° C. for temperature control. The fixability was evaluated by rubbing the toner image with a lens cleaning paper ("Dasper" (trade name), made by Ozu Paper Co., Ltd.) under a weight of 50 g/cm$^2$ and then evaluating the degree of peeling of the toner image. A fixing initiation temperature was defined as a fixing temperature giving a decrease in reflection density after rubbing of below 10%. Offset was evaluated by eye observation to measure a lower offset-free temperature and a higher offset-free temperature between which offset was not caused. The results are summarized in Table 3 which shows the fixing initiation temperature ($T_{FI}$), a density decrease between before and after rubbing after fixing at 160° C., a lower offset-free temperature ($T_{OFL}$), and a higher offset-free temperature ($T_{OFH}$), Developing performance test About 150 g of the toner was charged in a commercially available electrophotographic copying machine ("NP-4835", mfd. by Canon K. K.) and subjected to successive copying of 5000 sheets to evaluate the developing performance in terms of anti-electrostatic offset characteristic, image density, toner melt-sticking and toner blotches based on the following standards, respectively.

(Anti-electrostatic effect characteristic)

⊙: No electrostatic offset is observed.

o: Electrostatic offset is lightly observed in a very narrow region of a copied image as an image defect or an inferior image portion (in definition or in reproducibility of original image).

Δ: Electrostatic offset is observed as an image defect or inferior image portion in a broad region of a copied image.

x: Electrostatic offset is observed as a noticeable image defect or a desidely inferior image portion in a broad region of a copied image.

(Toner melt-sticking)

⊙: No melt-sticking of toner onto an OPC photosensitive drum is observed.

o: Toner melt-sticking onto an OPC photosensitive drum is slightly observed but its influence (e.g., occurrence of an inferior image portion (in definition or in reproducibility of original image) or occurrence of image defects such as black spots) on an copied image is not confirmed.

Δ: Toner melt-sticking onto an OPC photosensitive drum is observed and its adverse influence on an copied image is also confirmed.

x: Toner melt-sticking onto an OPC photosensitive drum is noticeably observed and its adverse influence on an copied image is also clearly confirmed.

(Toner blotches)

Herein, "toner blotches" are a state such that a toner coat layer on a developing sleeve shows an irregularity in thickness to assume, e.g., a ripple or wave shape. Toner blotches may generally be caused due to uniform triboelectric chargeability of a toner, conveyance failure of the toner, etc. If the toner blotches are generated on the developing sleeve, a resultant copied image is accompanied with difficulties, such as image failure, fog, lower image density and a ripple-shape image portion having ununiform image density. Specific evaluation standards are as follows.

⊙: No toner blotch is observed.

o: Toner blotch are slightly observed but its influence on an copied image is not confirmed.

Δ: Toner blotch is observed and its influence on an copied image is also slightly confirmed.

x: Toner blotch is noticeably observed and its influence on an copied image is also clearly confirmed.

Anti-blocking characteristic test

About 10 g of the toner was placed in a 100 cc-plastic cup and left standing for 3 days at 50° C. Thereafter, the anti-blocking characteristic was evaluated by eye observation based on the following standards.

⊙: No agglomerate is observed.

o: Agglomerate is observed but collapses easily.

Δ: Agglomerate is observed but is collapsed by shaking.

x: Agglomerate can be grasped and is not collapsed easily.

Example 2

A toner No. 2 was prepared and evaluated in the same manner as in Example 1 except that 2 wt. parts of wax A and 2 wt. parts of wax D were used.

The results of the DSC measurement of the wax mixture and the evaluation of the toner are shown in Tables 2 and 3, respectively.

Example 3

A toner No. 3 was prepared and evaluated in the same manner as in Example i except that 4 wt. parts of wax B and 2 wt. parts of wax E were used.

The results are also shown in Tables 2 and 3.

Example 4

A toner No. 4 was prepared and evaluated in the same manner as in Example I except that 4 wt. parts of wax B and 2 wt. parts of wax D were used.

The results are also shown in.Tables 2 and 3.

Example 5

A toner No. 5 was prepared and evaluated in the same manner as in Example i except that 2 wt. parts of wax A and 2 wt. parts of wax F were used.

The results are also shown in Tables 2 and 3.

Example 6

A toner No. 6 was prepared and evaluated in the same manner as in Example 1 except that 4 wt. parts of wax B and 2 wt. parts of wax F were used.

The results are also shown in Tables 2 and 3.

Example 7

A toner No. 7 was prepared and evaluated in the same manner as in Example 6 except that a wax component (mixture) prepared by preliminary melt-kneading 4 wt. parts of wax B and 2 wt. parts of wax F under stirring and then by cooling, solidifying and pulverizing the kneaded was mixture was used.

The results are also shown in Tables 2 and 3.

Example 8

A toner No. 8 was prepared and evaluated in the same manner as in Example 6 except that a binder resin containing a wax component (mixture), prepared in such a manner that 100 wt. parts of binder resin-1 is dissolved in xylene and heated with which 4 wt. parts of wax B and 2 wt. parts of wax F were added and mixed under stirring, followed by distilling-off of the solvent and drying, was used.

The results are shown in Tables 2 and 3.

Example 9

A toner No. 9 was prepared and evaluated in the same manner as in Example 9 except that 2 wt. parts of wax J and 2 wt. parts of wax K were used.

The results are also shown in Tables 2 and 3.

Comparative Example 1

A toner No. 10 (comparative) was prepared and evaluated in the same manner as in Example 1 except that 4 wt. parts of wax G and 2 wt. parts of wax F were used. Compared with the toner No. 1 used in Example 1, the toner No. 10 was inferior in low-temperature fixability and anti-offset characteristic. The toner No. 10 also caused melt-sticking onto the OPC photosensitive drum.

The results are also shown in Tables 2 and 3.

Comparative Example 2

A toner No. 11 (comparative) was prepared and evaluated in the same manner as in Example 1 except that 8 wt. parts of wax H and 2 wt. parts of wax F were used. The toner No. 11 was inferior to the toner No. 1 used in Example 1 in low-temperature fixability, anti-electrostatic offset, and image density.

The results are also shown in Tables 2 and 3.

Comparative Example 3

A toner No. 12 (comparative) was prepared and evaluated in the same manner as in Example 1 except that 4 wt. parts of wax B and 2 wt. parts of wax I were used. The toner No. 12 was inferior to the toner No. 1 used in Example 1 in high-temperature anti-offset characteristic and anti-electrostatic offset characteristic. The toner No. 12 also provided blotch on the developing sleeve.

The results are also shown in Tables 2 and 3.

Comparative Example 4

A toner No. 13 (comparative) was prepared and evaluated in the same manner as in Example 1 except that 8 wt. parts of wax H and 2 wt. parts of wax I were used. The toner No. 13 was inferior to the toner No. 1 used in Example 1 in low-temperature fixability, anti-offset characteristic and anti-electrostatic offset characteristic. The toner No. 13 also caused melt-sticking onto the OPC photosensitive drum and blotch on the developing sleeve.

The results are also shown in Tables 2 and 3.

Comparative Example 5

A toner No. 14 (comparative) was prepared and evaluated in the same manner as in Example 1 except that 3 wt. parts of wax L ("paraffin wax 135°", mfd. by Nippon Sekiyu K. K.) and 10 wt. parts of wax M (low-molecular weight polypropylene wax, "Viscol 550P", mfd. by Sanyo Kasei Kogyo K. K.) was used. The toner No. 14 was inferior to the toner No. 1 used in Example 1 in anti-blocking characteristic and image density.

The results are also shown in Tables 2 and 3.

Comparative Example 6

A toner No. 15 (comparative) was prepared and evaluated in the same manner as in Example 1 except that 2 wt. parts of wax F was used as a wax component. The toner No. 15 was inferior to the toner No. 1 used in Example 1 in low-temperature fixability.

The results are also shown in Tables 2 and 3.

Comparative Example 7

A toner No. 16 (comparative) was prepared and evaluated in the same manner as in Example 1 except that 2 wt. parts of wax B was used as a wax component. The toner No. 16 was inferior to the toner No. 1 used in Example 1 in anti-offset characteristic at high temperature.

The results are also shown in Tables 2 and 3.

Comparative Example 8

A toner No. 17 (comparative) was prepared and evaluated in the same manner as in Example 1 except that no wax component was used. The toner No. 17 was inferior to the toner No. 1 used in Example 1 in low-temperature fixability and high-temperature anti-offset characteristic.

The results are also shown in the following Tables 2 and 3.

TABLE 1

| Wax | $S_1$-OP*1 (°C.) | $P_{max}$*2 (°C.) | $LP_{max}$*3 (°C.) | $HP_{max}$*4 (°C.) | $W_{1/2}$*5 (°C.) |
|---|---|---|---|---|---|
| | DSC characteristics of Waxes | | | | |
| A | 68 | 76 | 74 | 77 | 3 |
| B | 52 | 69 | 65 | 80 | 15 |
| C | 122 | 127 | 124 | 129 | 5 |
| D | 80 | 96 | 92 | 99 | 7 |
| E | 100 | 124 | 111 | 129 | 18 |
| F | 72 | 111 | 94 | 113 | 19 |
| G | 60 | 78 | 67 | 85 | 18 |
| H | 52 | 64 | 56 | 77 | 21 |
| I | 70 | 122 | 92 | 130 | 38 |
| J | 54 | 62 | 60 | 63 | 3 |

TABLE 1-continued

| Wax | $S_1$-OP*1 (°C.) | $P_{max}$*2 (°C.) | $LP_{max}$*3 (°C.) | $HP_{max}$*4 (°C.) | $W_{1/2}$*5 (°C.) |
|---|---|---|---|---|---|
| | DSC characteristics of Waxes | | | | |
| K | 133 | 137 | 134 | 139 | 5 |
| L*6 | 39 | 63 | 60 | 64 | 4 |
| M*7 | 130 | 137 | 133 | 140 | 7 |

(*1) $S_1$-OP: Minimum onset temperature,
(*2) $P_{max}$: Maximum heat absorption peak,
(*3) $LP_{max}$: Half-width initiation (lower-side) temperature of maximum heat absorption peak,
(*4) $HP_{max}$: Half-width termination (higher-side) temperature of maximum heat absorption peak,
(*5) $W_{1/2}$: Half-width,
(*6) Wax L: "paraffin wax 135°", mfd. by Nippon Sekiyu K.K.,
(*7) Wax M: "Viscol 550P", mfd. by Sanyo Kasei K.K.

TABLE 2

| Ex. No. | Wax component | Maxing ratio of waxes (by wt.) | $S_1$-OP (°C.) | Lower-temp. side ($P_1$) Peak top temp. (°C.) | $H_1P$*1 (°C.) | Higher-temp. side ($P_2$) Peak top temp. (°C.) | $L_2P$*2 (°C.) | $L_2P$-$H_1P$ (°C.) | $W_{1/2}$ (°C.) Lower-temp. side ($P_1$) | $W_{1/2}$ (°C.) Higher-temp. side ($P_2$) |
|---|---|---|---|---|---|---|---|---|---|---|
| | | | DSC characteristics of Wax Mixtures | | | | | | | |
| Ex. | | | | | | | | | | |
| 1 | A/C | 1/1 | 68 | 76 | 77 | 177 | 113 | 36 | 4 | 8 |
| 2 | A/D | 1/1 | 67 | 76 | 77 | 94 | 88 | 11 | 4 | 10 |
| 3 | B/E | 2/1 | 53 | 69 | 81 | 118 | 104 | 23 | 17 | 18 |
| 4 | B/D | 2/1 | 52 | 68 | 80 | 95 | 90 | 10 | 18 | 11 |
| 5 | A/F | 1/1 | 66 | 75 | 76 | 106 | 88 | 12 | 4 | 19 |
| 6–8 | B/F | 2/1 | 52 | 69 | 80 | 105 | 89 | 9 | 16 | 17 |
| 9 | J/K | 1/1 | 54 | 63 | 64 | 112 | 101 | 37 | 5 | 13 |
| Comp. Ex. | | | | | | | | | | |
| 1 | G/F | 2/1 | 64 | 80 | 85 | 103 | 87 | 2 | 18 | 18 |
| 2 | H/F | 4/1 | 51 | 64 | 78 | 104 | 88 | 10 | 23 | 17 |
| 3 | B/I | 2/1 | 52 | 69 | 80 | 120 | 86 | 6 | 17 | 39 |
| 4 | H/I | 4/1 | 51 | 63 | 77 | 117 | 83 | 6 | 21 | 40 |
| 5 | L/M | 3/10 | 40 | 63 | 64 | 129 | 115 | 51 | 12 | 19 |

Figure 7:
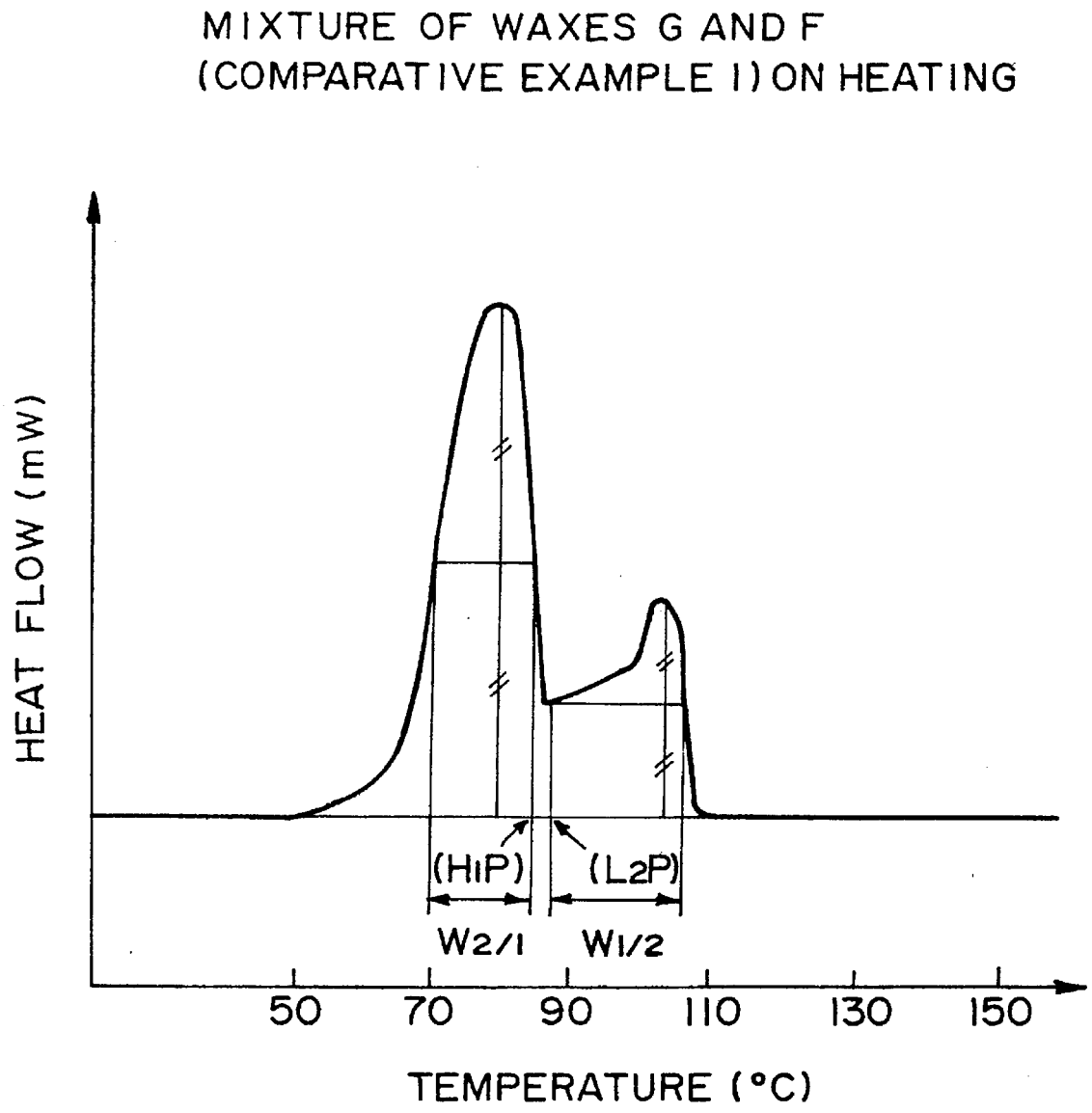

*1, *2: $H_1P$ and $L_1P$ are similar to $HP_{max}$ and $LP_{max}$ (*4 and *3 indicated in Table 1), respectively (as also shown in FIGS. 5 and 7).

TABLE 3

| Ex. No. | Toner No. | Wax component | Fixability $T_{FI}$ (°C.) | Fixability Density decrease (%) at 160° C. | Offset $T_{OFL}$ (°C.) | Offset $T_{OFT}$ (°C.) | Anti-electrostatic offset | Image density | Toner blotch | Toner melt-sticking | Toner Anti-blocking |
|---|---|---|---|---|---|---|---|---|---|---|---|
| | | | Evaluation of Toners | | | | | | | | |
| Ex. | | | | | | | | | | | |
| 1 | 1 | A/C | 145 | 1 | 140 | >240 | ◎ | 1.36 | ◎ | ◎ | ◎ |
| 2 | 2 | A/D | 145 | 1 | 140 | >240 | ◎ | 1.34 | ◎ | ○ | ◎ |
| 3 | 3 | B/E | 150 | 5 | 145 | 230 | ○ | 1.33 | ○ | ◎ | ◎ |
| 4 | 4 | B/D | 150 | 4 | 145 | >240 | ○ | 1.32 | ◎ | ○ | ◎ |
| 5 | 5 | A/F | 145 | 2 | 140 | 230 | ○ | 1.34 | ○ | ○ | ◎ |
| 6 | 6 | B/F | 150 | 4 | 145 | 230 | ○ | 1.30 | ○ | ○ | ◎ |
| 7 | 7 | B/F | 150 | 4 | 145 | 230 | ○ | 1.31 | ○ | ○ | ◎ |
| 8 | 8 | B/F | 150 | 3 | 145 | 230 | ○ | 1.31 | ◎ | ○ | ◎ |
| 9 | 9 | J/K | 145 | 2 | 140 | 230 | ◎ | 1.32 | ○ | ◎ | ○ |
| Comp. Ex. | | | | | | | | | | | |
| 1 | 10 | G/F | 160 | 10 | 155 | 210 | ○ | 1.26 | Δ | x | ◎ |
| 2 | 11 | H/F | 165 | 14 | 160 | 220 | Δ | 1.03 | ○ | ○ | ○ |

TABLE 3-continued

| Evaluation of Toners | | | | | | | | | | | |
|---|---|---|---|---|---|---|---|---|---|---|---|
| | | | Fixability | | | | Anti- | | | | |
| | | | | Density | Offset | | electro- | | | Toner | |
| Ex. No. | Toner No. | Wax component | $T_{H}$ (°C.) | decrease (%) at 160° C. | $T_{OFL}$ (°C.) | $T_{OFT}$ (°C.) | static offset | Image density | Toner blotch | melt-sticking | Anti-blocking |
| 3 | 12 | B/I | 155 | 8 | 150 | 200 | Δ | 1.23 | x | Δ | ⊙ |
| 4 | 13 | H/I | 165 | 15 | 160 | 200 | x | 1.01 | x | Δ | o |
| 5 | 14 | L/M | 155 | 9 | 150 | 220 | o | 1.12 | o | ⊙ | x |
| 6 | 15 | F | 180 | 65 | 175 | 220 | o | 1.24 | o | ⊙ | ⊙ |
| 7 | 16 | B | 155 | 7 | 150 | 190 | o | 1.21 | ⊙ | ⊙ | ⊙ |
| 8 | 17 | — | 180 | 63 | 175 | 190 | ⊙ | 1.13 | ⊙ | ⊙ | ⊙ |

What is claimed is:

1. A toner for developing an electrostatic image, comprising: a binder resin, a colorant or a magnetic material, and a wax component; wherein the wax component provides a DSC curve on temperature increase, as measured by a differential scanning calorimeter, showing a minimum onset temperature of heat absorption of at least 50° C. and at least two heat absorption peaks including a largest peak and a second largest peak of which a lower temperature peak $P_1$ and a higher temperature peak $P_2$ have a peak temperature difference therebetween of at least 15° C., the lower temperature peak $P_1$ shows a half-value width of at most 20° C. between a lower half-width temperature $L_1P$ and a higher half-width temperature $H_1P$, and the higher temperature peak $P_2$ shows a half-value width of at most 20° C. between a lower half-width temperature $L_2P$ and a higher half-width temperature H2P, satisfying:

$$L_2P-H_1P \geqq 5° \text{ C.}$$

2. The toner according to claim 1, wherein the lower temperature peak $P_1$ has a half-value width of at most 10° C. and the higher temperature peak $P_2$ has a half-value width of at most 15° C.

3. The toner according to claim 1 or 2, wherein the higher half-width temperature $H_1P$ of the lower temperature peak $P_1$ and the lower half-width temperature $L_2P$ of the higher temperature peak $P_2$ satisfy:

$$L_2P-H_1P \geqq 15° \text{ C.}$$

4. The toner according to Claim 1, wherein the wax component is contained in an amount of 0.2–20 wt. parts per 100 wt. parts of the binder resin.

5. The toner according to claim 1, wherein said hydrocarbon wax is contained in an amount of 0.5–10 wt. parts per 100 wt. parts of the binder resin.

6. The toner according to claim 1, wherein the binder resin comprises a styrene copolymer.

7. The toner according to claim 6, wherein the binder resin provides a GPC chromatogram showing a peak in a molecular weight region of $3\times10^3$–$5\times10^4$ and a peak in a molecular weight region of at least $10^5$.

8. The toner according to claim 1, wherein the binder resin comprises a polyester resin.

9. The toner according to claim 8, wherein the binder resin provides a GPC chromatogram showing a main peak in the molecular weight region of $3\times10^3$ - $1.5\times10^4$.

10. The toner according to claim 1, wherein the wax components comprises at least two waxes providing different maximum heat absorption peaks on a DSC curve on temperature increase.

11. The toner according to claim 10, wherein the wax component comprises 0.1–15 wt. parts of a wax showing a higher half-width temperature of its heat absorption peak in a temperature region 60°–100° C. and 0.1–12 wt. parts of a wax showing a lower half-width temperature of its heat absorption peak in a temperature region of 90°–140° C.

12. The toner according to claim 1, wherein the lower temperature peak $P_1$ is present in a temperature region of 55°–90° C. and the higher temperature peak $P_2$ is present in a temperature region of above 90° C. to 150° C.

13. The toner according to claim 1, wherein the lower temperature peak $P_1$ is present in a temperature region of 60°–85° C. and the higher temperature peak $P_2$ is present in a temperature region of 95°–130° C.

14. The toner according to claim 1, wherein the wax component shows the lower temperature peak $P_1$ as the largest peak and the higher temperature peak $P_2$ as the second largest peak on a DSC curve on temperature increase.

15. The toner according to claim 1, wherein the wax component comprises a low-melting point wax and a high-melting point wax.

16. The toner according to claim 15, wherein the low-melting point wax shows a maximum heat absorption peak in a temperature region of 55°–90° C. and shows a half-value width of the peak of at most 20° C., and the high-melting point wax shows a maximum heat absorption peak in a temperature region of above 90° C. to 150° C. and shows a half-value width of the peak of at most 20° C.

17. The toner according to claim 15, wherein the low-melting point wax shows a maximum heat absorption peak in a temperature region of 60°–85° C. and shows a half-value width of the peak of at most 10° C., and the high-melting point wax shows a maximum heat absorption peak in a temperature range of 95°–130° C. and shows a half-value width of the peak of at most 15° C.

18. The toner according to claim 16, wherein the low-melting point wax shows a maximum heat absorption peak temperature and the high-melting point wax shows a maximum heat absorption peak temperature, providing a temperature difference therebetween of 15°–95° C.

19. The toner according to claim 17, wherein the low-melting point wax shows a maximum heat absorption peak temperature and the high-melting point wax shows a maximum heat absorption peak temperature, providing a temperature difference therebetween of 35°–70° C.

20. The toner according to claim 1, wherein the wax component comprises a wax prepared by vacuum distillation to have a sharp molecular weight distribution.

21. The toner according to claim 1, wherein the wax component comprises a wax prepared by fractional crystallization to have a sharp molecular weight distribution.

* * * * *

UNITED STATES PATENT AND TRADEMARK OFFICE

CERTIFICATE OF CORRECTION

PATENT NO. : 5,605,778

DATED : February 25, 1997

INVENTOR(S) : TSUTOMU ONUMA ET AL.

It is certified that error appears in the above-identified patent and that said Letters Patent is hereby corrected as shown below:

AT [57] ABSTRACT

Line 7, "colorimeter)" should read --calorimeter)--.
Line 11, "peaks," should read --peak,--.
Line 12, "low-temperature" should read --a lower-temperature--.
Line 17, "form" should read --from--.

SHEET 5 OF 7

FIG. 5, "(EXAMPE 1)" should read --(EXAMPLE 1)--.

COLUMN 1

Line 35, "an amount small" should read --small amounts--.
Line 37, "wormed up" should read --wound up--.
Line 45, "have" should read --has--.

COLUMN 3

Line 21, "peak $P_1$" should read --peak $P_2$--.

COLUMN 5

Line 57, "respects" should read --respect--.

COLUMN 6

Line 18, "ar" should read --are--.
Line 53, "fixability.and" should read --fixability and--.

UNITED STATES PATENT AND TRADEMARK OFFICE

CERTIFICATE OF CORRECTION

PATENT NO. : 5,605,778

DATED : February 25, 1997

INVENTOR(S) : TSUTOMU ONUMA ET AL.

It is certified that error appears in the above-identified patent and that said Letters Patent is hereby corrected as shown below:

COLUMN 7

Line 56, "$W_{1/2}$of" should read --$W_{1/2}$ of--.
Line 60, "(L2P)" should read --($L_2P$)--.

COLUMN 8

Line 39, "chmarone-indene" should read --cumarone-indene--.

COLUMN 9

Line 49, "constitute" should read --constitutes--.

COLUMN 10

Line 10, "t-butylcumul" should read --t-butylcumyl--.
Line 11, "mul" should read --myl--.
Line 26, "(tbutylperoxycarbonate)," should read --(t-butyperoxycarbonate),--.

COLUMN 11

Line 24, "acids," should read --acid,--.
Line 54, "respects" should read --respect--.
Line 63, "respects" should read --respect--.

UNITED STATES PATENT AND TRADEMARK OFFICE

CERTIFICATE OF CORRECTION

PATENT NO. : 5,605,778

DATED : February 25, 1997

INVENTOR(S) : TSUTOMU ONUMA ET AL.

It is certified that error appears in the above-identified patent and that said Letters Patent is hereby corrected as shown below:

COLUMN 12

Line 1, "she-methacrylate" should read --ene-methacrylate--.
Line 2, "styrshe-methacrylate" should read --styrene-methacrylate--.
Line 6, "respects" should read --respect--.
Line 20, "respects" should read --respect--.
Line 52, close up right margin.
Line 53, close up left margin and "Further" should read --Further,--.
Line 58, "of" should read --to--.
Line 61, "$3x10^3$" should read --$3x10^3$,--.
Line 64, "$1.5x10^4$" should read --$1.5x10^4$,--.
Line 67, "$1.5x10^4$" should read --$1.5x10^4$,--.

COLUMN 13

Line 12, "shaked" should read --shaken--.
Line 58, "guar-" should read --qua- --.
Line 61, "homologous" should read --homologrus--.

COLUMN 14

Line 7, "quarternary" should read --quaternary--.
Line 58, "complexes" should read --complexes,--.

UNITED STATES PATENT AND TRADEMARK OFFICE

CERTIFICATE OF CORRECTION

PATENT NO. : 5,605,778

DATED : February 25, 1997

INVENTOR(S) : TSUTOMU ONUMA ET AL.

It is certified that error appears in the above-identified patent and that said Letters Patent is hereby corrected as shown below:

COLUMN 15

Line 18, "hydrogen, ion," should read --hydrogen ion,--.
Line 24, "ion. $A^{\oplus}$" should read --ion $A^{\oplus}$--.
Line 42, "Ni" should read --Ni,-- and
"Al" should read --Al,--.

COLUMN 16

Line 30, "Iin" should read --In--.

COLUMN 18

Line 62, "frank" should read --flask--.

COLUMN 19

Line 34, "preliminary" should read --preliminarily--.
Line 38, "melti-division" should read
--multi-division--.
Line 40, "weightaverage" should read
--weight-average--.

COLUMN 20

Line 20, "($T_{OFH}$)," should read --($T_{OFH}$).--.
Line 38, "desidely" should read --decidedly--.
Line 47, "an" should read --a--.
Line 49, "an" should read --a--.
Line 52, "an" should read --a--.
Line 66, "are" should read --is--.
Line 67, "an" should read --a--.

UNITED STATES PATENT AND TRADEMARK OFFICE

CERTIFICATE OF CORRECTION

PATENT NO. : 5,605,778

DATED : February 25, 1997

INVENTOR(S) : TSUTOMU ONUMA ET AL.

It is certified that error appears in the above-identified patent and that said Letters Patent is hereby corrected as shown below:

COLUMN 21

Line 1, "an" should read --a--.
Line 4, "an" should read --a--.
Line 21, "Example i" should read --Example 1--.
Line 26, "Example I" should read --Example 1--.
Line 28, "in." should read --in--.
Line 31, "Example i" should read --Example 1--.
Line 42, "preliminary" should read --preliminarily--.
Line 44, "was" should be deleted.
Line 57, "Example 9" should read --Example 1--.

COLUMN 23

Table 2, "Maxing" should read --Mixing--.

UNITED STATES PATENT AND TRADEMARK OFFICE

CERTIFICATE OF CORRECTION

PATENT NO. : 5,605,778

DATED : February 25, 1997

INVENTOR(S) : TSUTOMU ONUMA ET AL. Page 6 of 6

It is certified that error appears in the above-identified patent and that said Letters Patent is hereby corrected as shown below:

COLUMN 25

Line 32, "H2P," should read --$H_2P$,--.
Lines 49-50, "hydrocarbon wax" should read --wax component--.
Line 61, "$3x10^3$ - $1.5x10^4$." should read --$3x10^3$-$1.5x10^4$.--.
Line 63, "components" should read --component--.

Signed and Sealed this

Sixteenth Day of September, 1997

Bruce Lehman

*Attest:*

BRUCE LEHMAN

*Attesting Officer*

*Commissioner of Patents and Trademarks*